US010765170B2

(12) United States Patent
Langvin et al.

(10) Patent No.: US 10,765,170 B2
(45) **Date of Patent: *Sep. 8, 2020**

(54) ARTICLE OF FOOTWEAR WITH ADAPTIVE FIT

(71) Applicant: NIKE, Inc., Beaverton, OR (US)

(72) Inventors: Elizabeth Langvin, Sherwood, OR (US); Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 14 days.

This patent is subject to a terminal disclaimer.

(21) Appl. No.: 16/189,208

(22) Filed: Nov. 13, 2018

(65) Prior Publication Data

US 2019/0075885 A1 Mar. 14, 2019

Related U.S. Application Data

(63) Continuation of application No. 15/474,328, filed on Mar. 30, 2017, now Pat. No. 10,165,825.

(Continued)

(51) Int. Cl.

| | |
|---|---|
| ***A43B 3/24*** | (2006.01) |
| ***A43B 13/14*** | (2006.01) |
| ***A43B 13/12*** | (2006.01) |
| ***A43B 13/22*** | (2006.01) |
| ***A43B 3/26*** | (2006.01) |

(Continued)

(52) U.S. Cl.

CPC ..... *A43B 13/141* (2013.01); *A43B 3/24* (2013.01); *A43B 3/26* (2013.01); *A43B 9/02* (2013.01); *A43B 9/12* (2013.01); *A43B 13/04* (2013.01); *A43B 13/12* (2013.01); *A43B 13/122* (2013.01); *A43B 13/125* (2013.01); *A43B 13/145* (2013.01); *A43B 13/146* (2013.01); *A43B 13/186* (2013.01); *A43B 13/188* (2013.01); *A43B 13/22* (2013.01); *A43B 13/223* (2013.01);

(Continued)

(58) Field of Classification Search

CPC ..... A43B 3/24; A43B 3/246; A43B 3/248; A43B 3/26

USPC ..... 36/97, 102, 103, 100, 31

See application file for complete search history.

(56) References Cited

U.S. PATENT DOCUMENTS 3,909,862 A * 10/1975 Auberry ..... A43D 11/00 12/142 R 5,060,402 A 10/1991 Rosen (Continued)

FOREIGN PATENT DOCUMENTS

| | | |
|---|---|---|
| CN | 1446058 A | 10/2003 |
| CN | 101184408 A | 5/2008 |
| WO | 0187106 A3 | 11/2001 |

*Primary Examiner* — Marie D Bays

(74) *Attorney, Agent, or Firm* — Quinn IP Law

(57) ABSTRACT

A sole includes an outer sole assembly including a plurality of outer sole members spaced apart from each other by a plurality of gaps. In addition, the sole includes a middle sole assembly defining a plurality of grooves, and an intermediate layer comprising an elastomer. The intermediate layer is disposed between the outer sole assembly and the middle sole assembly. The intermediate layer connects the middle sole assembly to the outer sole assembly. The intermediate layer is more elastic than each of the plurality of outer sole members. The intermediate layer is more elastic than the middle sole assembly. At least one of the gaps is vertically aligned with one of the grooves.

20 Claims, 31 Drawing Sheets

Related U.S. Application Data

(60) Provisional application No. 62/316,926, filed on Apr. 1, 2016.

(51) Int. Cl.

| | |
|---|---|
| ***A43B 9/02*** | (2006.01) |
| ***A43B 9/12*** | (2006.01) |
| ***A43B 13/04*** | (2006.01) |
| ***A43B 13/18*** | (2006.01) |
| ***A43B 23/02*** | (2006.01) |

(52) U.S. Cl.
CPC ..... *A43B 23/028* (2013.01); *A43B 23/0215* (2013.01)

(56) References Cited

U.S. PATENT DOCUMENTS 7,249,426 B2 * 7/2007 Romano ..... A43B 3/00 12/142 E
7,814,686 B2 * 10/2010 Becker ..... A43B 13/026 36/102
8,356,428 B2 * 1/2013 Auger ..... A43B 5/02 36/102
8,776,400 B2 * 7/2014 James ..... A43B 13/141 36/102
10,165,825 B2 * 1/2019 Langvin ..... A43B 3/26
2002/0078591 A1 * 6/2002 Morrone ..... A43B 5/12 36/8.3
2004/0250446 A1 * 12/2004 Greene ..... A43B 7/08 36/25 R
2013/0118038 A1 * 5/2013 Fallow, Jr. ..... A43B 3/0042 36/103
2013/0152428 A1 * 6/2013 Bishop ..... A43B 13/16 36/103
2014/0013624 A1 * 1/2014 Stockbridge ..... A43B 13/00 36/103
2014/0101973 A1 * 4/2014 Luedecke ..... A43B 13/141 36/103
2014/0250723 A1 * 9/2014 Kohatsu ..... A43B 3/26 36/88
2014/0373392 A1 * 12/2014 Cullen ..... A43B 1/00 36/103
2015/0075033 A1 * 3/2015 Cross ..... A43B 13/226 36/103
2015/0143722 A1 5/2015 Faggin et al.
2015/0245686 A1 * 9/2015 Cross ..... A43B 13/02 36/29
2016/0000180 A1 * 1/2016 Cook ..... A43B 5/02 36/103
2016/0021974 A1 * 1/2016 Schindler ..... A43B 13/146 36/103
2017/0280823 A1 * 10/2017 Langvin ..... A43B 3/26

* cited by examiner

ARTICLE OF FOOTWEAR WITH ADAPTIVE FIT

CROSS-REFERENCE TO RELATED APPLICATION

This application is a continuation of U.S. patent application Ser. No. 15/474,328, filed on Mar. 30, 2017, which claims priority to, and the benefit of, U.S. Provisional Patent Application No. 62/316,926, filed on Apr. 1, 2016.

BACKGROUND

The present embodiments relate generally to articles of footwear and in particular to components for improving the adaptability of articles of footwear.

Articles of footwear generally include two primary elements: an upper and a sole. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

The sole may be constructed to provide stability and cushioning. The sole may include an outsole, a midsole and an insole. The midsole provides support and cushioning while the outsole provides improved traction with the ground. The insole may provide increased comfort for the foot.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
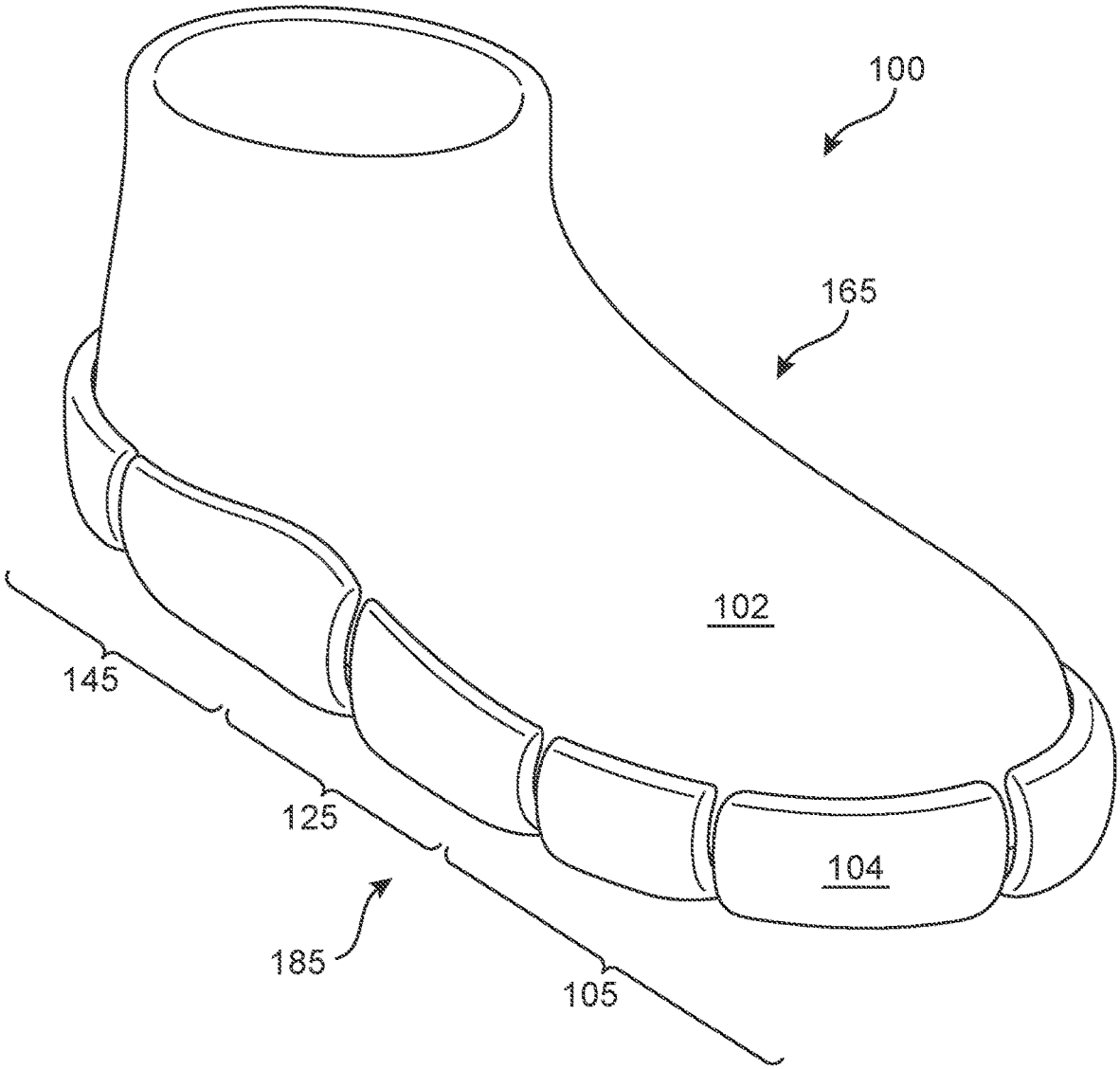
FIG. 1 is a schematic isometric view of an embodiment of an article of footwear.

The following discussion and accompanying figures disclose articles of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing. In some cases, a component may be identified with a longitudinal axis as well as a forward and rearward longitudinal direction along that axis.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot. In some cases, a component may be identified with a lateral axis, which is perpendicular to a longitudinal axis. Opposing directions along the lateral axis may be directed towards the lateral and medial sides of the component.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upwards" refers to the vertical direction pointing towards a top of the article, which may include an instep, a fastening region and/or a throat of an upper. The term "downwards" refers to the vertical direction pointing opposite the upwards direction, and may generally point towards the sole, or towards the outermost components of the sole.

The "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

The present disclosure describes a sole. In certain embodiments, the sole includes an outer sole assembly including a plurality of outer sole members spaced apart from each other by a plurality of gaps. In addition, the sole includes a middle sole assembly defining a plurality of grooves, and an intermediate layer comprising an elastomer. The intermediate layer is disposed between the outer sole assembly and the middle sole assembly. The intermediate layer connects the middle sole assembly to the outer sole assembly. The intermediate layer is more elastic than each of the plurality of outer sole members. The intermediate layer is more elastic than the middle sole assembly. At least one of the gaps is vertically aligned with one of the grooves. The intermediate layer may extend across at least one groove to separate the at least one groove from a vertically aligned gap. The outer sole assembly may further include at least one connecting member that locally couples two adjacent outer sole members. The intermediate layer may be a TPU membrane. The intermediate layer may have a different material composition than either the middle sole assembly or the outer sole assembly. The sole may be configured to expand along at least one of the plurality of gaps upon application of a downward force to the sole. The intermediate layer may be a unitary, one-piece structure. The grooves do not necessarily extend through an entirety of a thickness of the middle sole assembly. At least some of the gaps may extend through the entire thickness of the outer sole assembly. The intermediate layer may include a continuous medial side and a plurality of finger-like portions extending from the continuous medial side toward a lateral side of sole. The outer sole assembly may include a base sole portion and a peripheral sole portion extending from the base sole portion. The peripheral sole portion may be configured to wrap up around a lower peripheral edge of an upper. The outer sole members may include a forwardly disposed outer sole member, and the outer sole assembly includes a first tread pad and a second tread pad each coupled to the forwardly disposed outer sole member. The gaps may include a peripheral gap partially disposed between the first tread pad and the second tread pad.

The present disclosure also describes articles of footwear. In certain embodiments, the article of footwear includes an upper including a bottom portion and a lower region coupled to the bottom portion. Further, the article of footwear includes a sole comprising a middle sole assembly and an outer sole assembly. The outer sole assembly includes a peripheral sole portion that wraps up around and attaches to the lower region of the upper. The outer sole assembly includes a lateral outer sole member and a medial outer sole member. The lateral outer sole member and the medial outer sole member are spaced apart by a gap. The middle sole assembly include a lateral middle sole member and a medial middle sole member. The lateral middle sole member and the medial middle sole member are spaced apart by a groove. The sole further includes an intermediate layer connecting the middle sole assembly and the outer sole assembly. The bottom portion of the upper is located inwardly of the middle sole assembly. The intermediate layer is more elastic than the outer sole assembly. The intermediate layer is more elastic than the middle sole assembly. The gap is vertically aligned with the groove. The intermediate layer may comprise an elastic material. The elastic material may be thermoplastic polyurethane. The gap may extend from a forward edge of the sole to a heel region of the sole. The groove may extend from the forward edge to the heel region. The intermediate layer may be a one-piece structure.

FIG. 1 is an isometric side view of an article of footwear ("article") 100. In the current embodiment, article 100 is shown in the form of an athletic shoe, such as a running shoe. However, in other embodiments, an article incorporating the principles and provisions taught with respect to the embodiments of the disclosure could take the form of other kinds of footwear including, but not limited to, hiking boots, soccer shoes, football shoes, sneakers, running shoes, cross-training shoes, rugby shoes, basketball shoes, baseball shoes and other kinds of shoes. Moreover, in some embodiments the disclosed provisions may be configured for use with various kinds of non-sports-related footwear, including, but not limited to, slippers, sandals, high-heeled footwear, loafers, and others.

As noted above, for consistency and convenience, directional adjectives are employed throughout this detailed description. Article 100 may be divided into three general regions along a longitudinal direction: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Article 100 may also include a medial side 165 and a lateral side 185 of the foot. Since various features of article 100 extend beyond one region of article 100, the terms forefoot region 105, midfoot region 125, and heel region 145, medial side 165 and lateral side 185 apply not only to article 100, but also to the various components (e.g., the upper or sole) of article 100.

Article 100 may include upper 102 and sole system 104, which may also be referred to simply as sole 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

Figure 2:
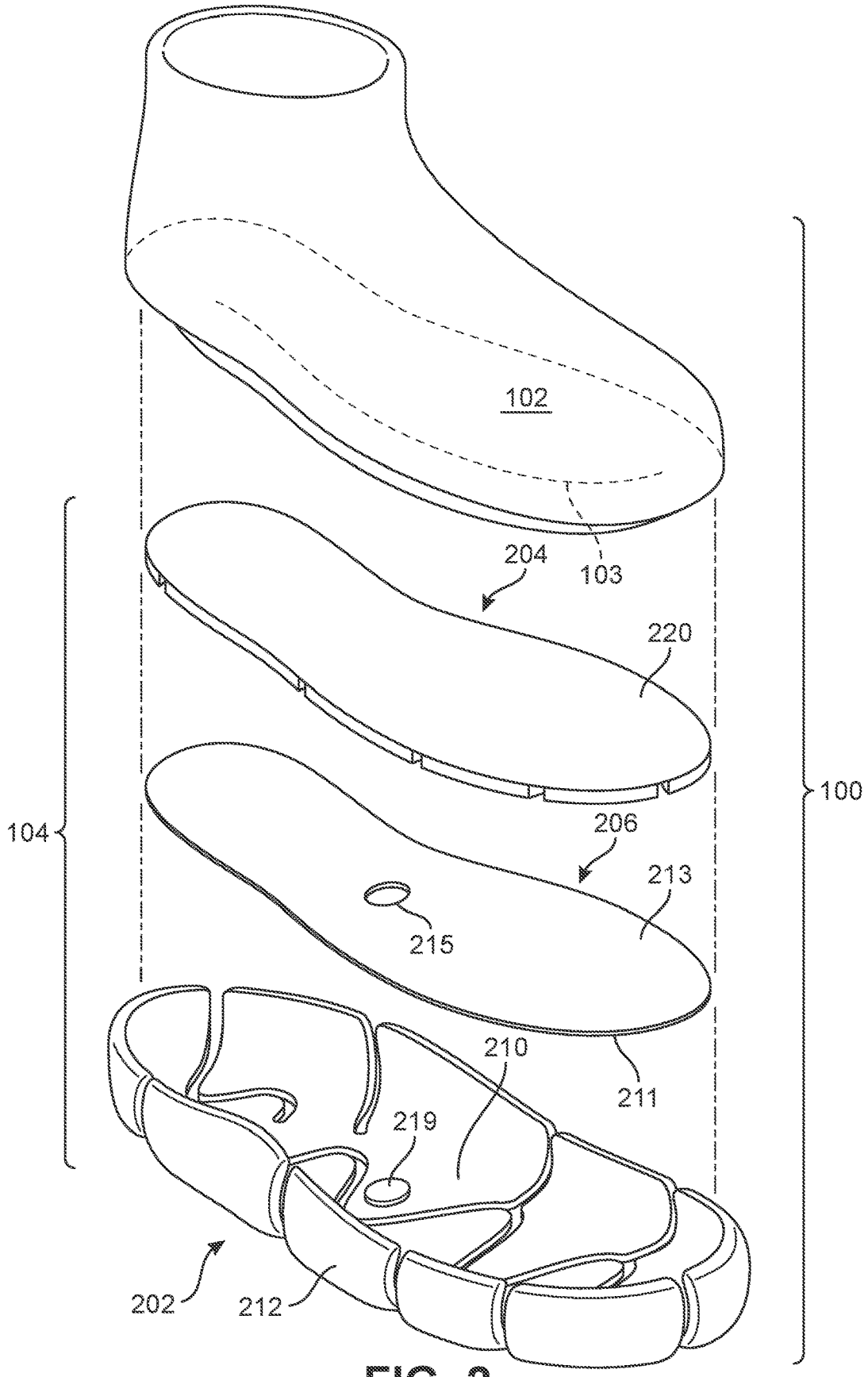
FIG. 2 is an exploded isometric view of the article of footwear of FIG. 1.

In different embodiments, the properties of upper 102 could vary. In some embodiments, upper 102 may be configured as a bootie-like, or sock-like, upper that provides full coverage of a foot, including coverage on the sole or bottom of the foot. In other embodiments, however, upper 102 could be open on a bottom portion. In the exemplary embodiment, upper 102 has a closed or bootie-like configuration, and includes a closed bottom portion 103, which is best seen in FIG. 2.

An upper can include provisions to reduce any tendency of the foot to be pulled away from the upper during use. In some embodiments, an upper may be 'tension fit'. As used herein, the term tension fit refers to a fit that ensures the upper is pulled against the foot at all times including on a lower side where the sole of the foot contacts a bottom portion of the upper. In some cases, a tension fit upper may be configured so that when no foot is present within an interior cavity of the upper, the interior cavity has a volume that is smaller than the volume after a foot has been inserted. In other words, the upper may be configured to stretch or expand as a foot is inserted. As discussed in further detail below, such a configuration may provide an upper that 'stays with' the foot, and especially the sole of the foot, at all times during any activities (e.g., running, jumping, walking, etc.). A tension fit may or may not require stretching in the upper. In some cases, the upper can be configured to stretch significantly when a foot is inserted. In other cases, however, the upper may simply fit the foot very snugly without significant expansion.

In different embodiments, a tension fit for an upper could be achieved in various ways. In some embodiments, an upper may be manufactured from various stretchy or elastic materials, such as nylon, so that the upper can be stretched to accommodate a foot larger than the neutral interior cavity size. In other embodiments, however, the upper could be formed with a structure that provides the desired tension. For example, in one embodiment, an upper may be a knit upper that is constructed (knitted) to have a desired degree of tension, or to be pre-tensioned.

At least a portion of sole system 104 may be fixedly attached to portions of upper 102 (for example, with adhesive, stitching, welding, or other suitable techniques) and may have a configuration that extends between upper 102 and the ground. Sole system 104 may include provisions for attenuating ground reaction forces (that is, cushioning and stabilizing the foot during vertical and horizontal loading). In addition, sole system 104 may be configured to provide traction, impart stability, and control or limit various foot motions, such as pronation, supination, or other motions. For example, the disclosed concepts may be applicable to footwear configured for use on any of a variety of surfaces, including indoor surfaces or outdoor surfaces. In some embodiments, sole system 104 may be configured to provide traction and stability on hard indoor surfaces (such as hardwood), soft, natural turf surfaces, or on hard, artificial turf surfaces.

As will be discussed further below, in different embodiments, a sole system may include different components, which may, individually or collectively, provide an article with a number of attributes, such as support, rigidity, flexibility, stability, cushioning, comfort, reduced weight, or other attributes. For example, a sole system may include an outsole, a midsole, a cushioning layer, and/or an insole. It may be appreciated however that sole system 104 is not limited to incorporating traditional sole components and may incorporate various different kinds of elements arranged at the outermost, inner most and intermediate 'layers', or locations, of the sole. Thus, a sole system can include an outer sole member or element, which may or may not coincide with a conventional 'outsole'. Likewise, a sole system may include an inner sole member or element, which may or may not coincide with a conventional 'insole'. Further, a sole system can include any number of intermediate and/or middle sole members or elements, which may or may not coincide with a conventional 'midsole'.

FIG. 2 illustrates an exploded isometric view of an embodiment of article 100. Referring to FIG. 2, sole system 104 may incorporate various different components. In some embodiments, sole system 104 may include an outer sole assembly 202, a middle sole assembly 204 and an intermediate layer 206. The intermediate layer 206 may be a unitary, one-piece structure.

Figure 3:
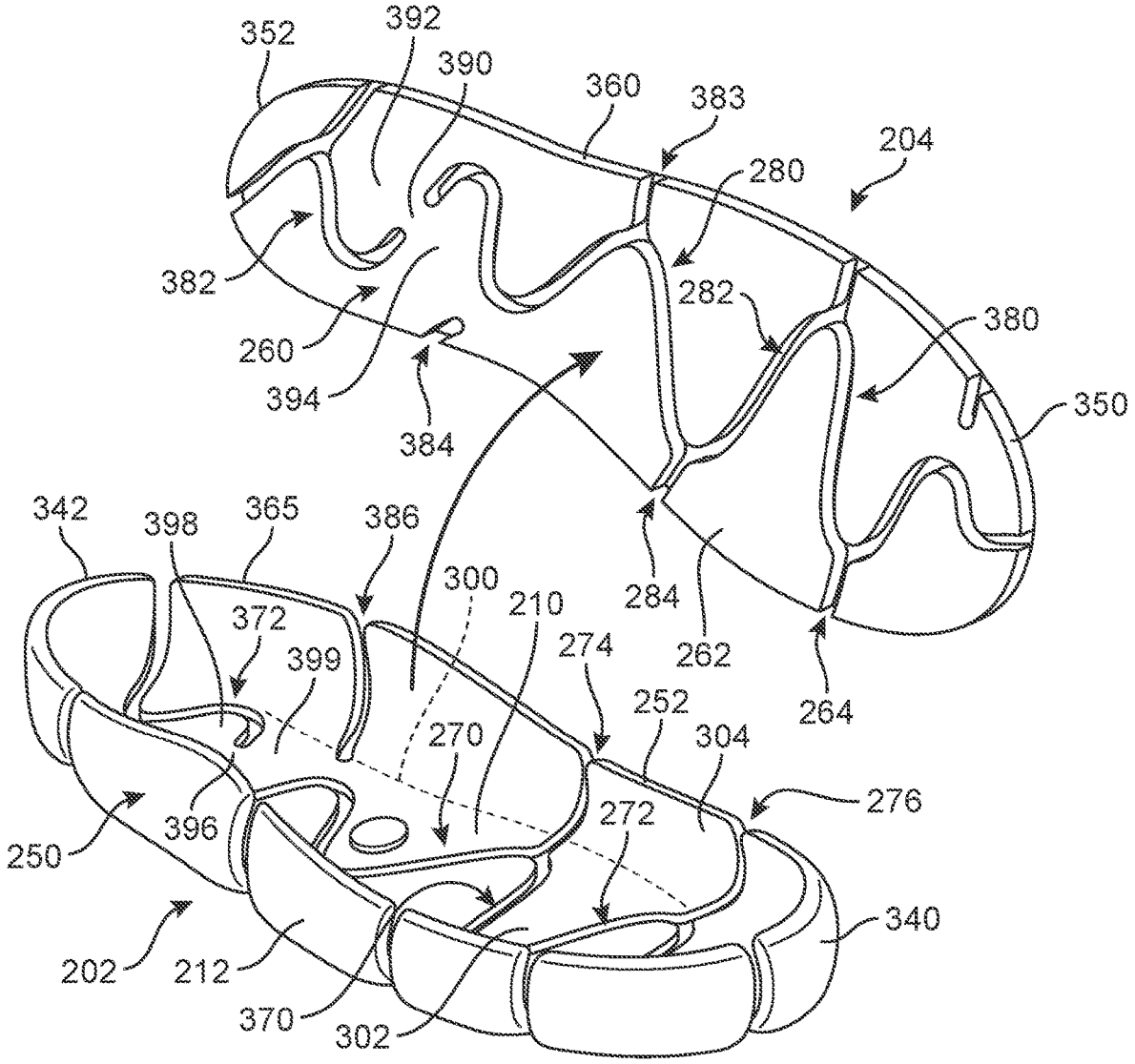
FIG. 3 is a schematic isometric view of an outer sole assembly and a middle sole assembly, according to an embodiment.

Outer sole assembly 202 may generally comprise the outermost component of sole system 104. As shown in FIGS. 2-3, outer sole assembly 202 may include a base sole portion 210 and a peripheral sole portion 212. In some cases, peripheral sole portion 212 curves up and away from base sole portion 210. In some cases, peripheral sole portion 212 may wrap up around the lower peripheral edge of upper 102, as seen in FIG. 1. In some embodiments, outer sole assembly 202 includes a ground contacting outer surface (e.g., the outer surface 410 of outer sole assembly 402 shown in FIG. 4).

Outer sole assembly 202 may be shaped to receive and fit both intermediate layer 206 and middle sole assembly 204. For purposes of clarity, the interior of outer sole assembly 202 is shown as substantially smooth, however in some embodiments outer sole assembly 202 can include recessed regions for receiving intermediate layer 206 and middle sole assembly 204, as seen, for example, in FIGS. 10-13. As shown in FIG. 2, middle sole assembly 204 is also seen in include an inner surface 220 that may be disposed proximate bottom portion 103 of upper 102.

Sole system 104 is seen to be comprised of two sole assemblies. Each assembly is further comprised of multiple sole members. In some cases, two or more sole members of the same sole assembly may be completely disconnected (e.g., via gaps as discussed below), but when arranged within sole system 104 they may still comprise a common layer or feature of sole system 104. Alternatively, some sole members could be spaced apart by grooves that don't extend through the entire thickness of the assembly, or by gaps that don't fully separate members in the horizontal plane.

FIG. 3 is a schematic view of outer sole assembly 202 and middle sole assembly 204. Referring to FIG. 3, outer sole assembly 202 may be comprised of a plurality of outer sole members 250. Each sole member in outer sole assembly 202 may comprise pieces or portions of sole material that are spaced apart. Likewise, middle sole assembly 204 may be comprised of a plurality of middle sole members 260. Each sole member in middle sole assembly 204 may comprise pieces or portions of sole material that are spaced apart.

Each member of a sole assembly may have a unique size and geometry that is determined by a pattern of gaps or grooves formed in each sole assembly. Because the embodiments may include materials that are fully or partially separated from one another, reference is made to 'gaps', which act to space apart members, elements or pieces of material through their entire thickness, and 'grooves', which extend into the surface of a component, but may not extend through the entire thickness of the component. In some cases, a gap could also be a cut which extends through the entire thickness of a component. Thus, for example, the gaps referred to below with respect to outer sole assembly 202 could also be referred to as cuts. Similarly, the grooves discussed in the context of middle sole assembly 204, for example, could also be referred to as cuts or sipes that do not extend through the full thickness of a component (or assembly).

In the embodiment of FIG. 3, the sole members of outer sole assembly 202 are spaced apart from one another by a set of gaps 270. Likewise, the sole members of middle sole assembly 204 are spaced apart from one another by a set of grooves 280. In the embodiment of FIG. 3, set of grooves 280 do not extend through the entire thickness of middle sole assembly 204, whereas at least some of the gaps in set of gaps 270 do extend through the entire thickness of outer sole assembly 202. The result is that many of the sole members in outer sole assembly 202 are completely separated (and spaced apart) from one another, while the sole members of middle sole assembly 204 are all joined at inner surface 220 by webbing or thin layers of sole material disposed proximate each groove.

As best seen in FIG. 3, plurality of outer sole members 250 may be in one-to-one correspondence with plurality of middle sole members 260. That is, each outer sole member may be associated with a unique middle sole member. As an example, plurality of outer sole members 250 includes an outer sole member 252 that is in correspondence with a middle sole member 262. This correspondence also applies between set of gaps 270 and set of grooves 280. Specifically, in some embodiments, each groove in set of grooves 280 may be in correspondence with a unique gap in set of gaps 270. For example, a first groove segment 282, a second groove segment 284 and a third groove segment 264 are in correspondence with a first gap segment 272, a second gap segment 274 and a third gap segment 276, respectively. Moreover, these corresponding gap and groove segments define the (non-peripheral) boundaries of middle sole member 262 and outer sole member 252.

Although the embodiment of FIG. 3 depicts sole assemblies with corresponding sole members, these correspondences are not complete with respect to the geometry of the members. In particular, due to the overall convex geometry of outer sole assembly 202, each sole member of outer sole assembly 202 includes a base or ground contacting portion and a peripheral portion. In contrast, the relatively flat (compared to outer sole assembly 202) geometry of middle sole assembly 204 means that each sole member lacks a portion corresponding with the peripheral portions of outer sole members. This arrangement is clearly illustrated in FIG. 3 by a boundary 300 that clarifies the separation between a base portion and a peripheral portion for each outer sole member. For example, outer sole member 252 is separated by boundary 300 into a base portion 302 and a peripheral portion 304. Base portion 302 has a peripheral, or edge, geometry that matches the peripheral, or edge, geometry of middle sole member 262. Thus, it may be said that for corresponding sole members at least some of their edges, but not all, may match.

Alternatively, in other embodiments, only some sole members from an outer sole assembly may be in correspondence with sole members from a middle sole assembly. In other words, in other embodiments, not every sole member of one assembly may be in correspondence with a unique sole member of another assembly.

In different embodiments, the particular pattern or arrangement of gaps and grooves in a sole assembly could vary. Generally, a pattern may be selected to achieve a desired type of flexibility, comfort, fit, dynamic response or other desirable characteristic for an article of footwear. The embodiments shown in FIGS. 1-25 use a pattern comprised of a corresponding gap and groove that extends along the entire length of the sole system while weaving back and forth in the lateral and medial directions, thereby achieving a tooth-like or interlocking finger arrangement between adjacent medial and lateral sole members.

An exemplary pattern of grooves in middle sole assembly 204 is depicted most clearly in FIG. 3. Referring to FIG. 3, set of grooves 280 includes a forward central groove 380 that extends from forward edge 350 of middle sole assembly 204 to heel region 145 and a rearward central groove 382 that extends through heel region 145 to a location proximate rearward edge 352 of middle sole assembly 204. Forward central groove 380 and rearward central groove 382 may be separated in heel region 145 by a connecting portion 390 that joins adjacent middle sole member 392 and middle sole member 394. It may be appreciated that connecting portion 390 may join the sole members through their entire thickness, in contrast to the webbing or thinner portions of sole material joining all the middle sole members at inner surface 220 of middle sole assembly 204.

Each central groove (e.g., forward central groove 380 and rearward central groove 382) generally extends through a central, or middle, region of middle sole assembly 204 while also winding in lateral directions to form a tooth-like or finger-like set of opposing projections on the lateral and medial sides. Moreover, at various intervals along the length of middle sole assembly 204, set of grooves 280 includes several grooves that extend inwards from peripheral edge 360 of middle sole assembly 204. Some of these grooves extend from peripheral edge 360 and join forward central groove 380, such as groove 383. Others, however, may not extend to central groove 380, such as groove 384. Similarly, grooves may extend from peripheral edge 360 and may or may not join with rearward central groove 382.

Referring to FIG. 3, set of gaps 270 includes a forward central gap 370 that extends from forward edge 340 of outer sole assembly 202 to heel region 145 and a rearward central gap 372 that extends through heel region 145 to rearward edge 342 of outer sole assembly 202. Forward central gap 370 and rearward central gap 372 may be separated in heel region 145 by a connecting portion 396 that joins adjacent outer sole member 398 and outer sole member 399. The connecting portion 396 may alternatively be referred to as a connecting member and locally couples two adjacent outer sole members 398, 399.

Each central gap (e.g., forward central gap 370 and rearward central gap 372) generally extends through a central, or middle, region of outer sole assembly 202 while also winding in lateral directions to form a tooth-like or finger-like set of opposing projections on the lateral and medial sides. Moreover, at various intervals along the length of outer sole assembly 202, set of gaps 270 includes several gaps that extend inwards from peripheral edge 365 of outer sole assembly 202. Some of these gaps extend from peripheral edge 365 to forward central gap 370, such as second gap segment 274. Other gaps (or gap segments), however, may not extend to a central gap, such as gap 386.

Generally, the pattern of gaps and/or grooves can be selected in any manner. In one embodiment, the pattern can be selected according to measurements of the center of pressure from during a motion from heel to toe off of the foot. Based on this center of pressure information, the pattern is determined so as to optimize the ability of the sole system to stay with the foot during use.

Referring back to FIG. 2, in some embodiments, intermediate layer 206 can include an outer surface 211 and an inner surface 213. Intermediate layer 206 may extend through a similar horizontal area as middle sole assembly 204. In other embodiments, however, intermediate layer 206 could have another geometry and may be selectively applied through various regions or areas of sole system 104. Such an alternative configuration for intermediate layer 206 is shown in FIG. 4 and described in further detail below.

In the embodiment shown in FIG. 2, intermediate layer 206 also includes a recess 215 for receiving a raised feature 219 of outer sole assembly 202. In some cases, recess 215 and raised feature 219 may facilitate alignment of intermediate layer 206 against outer sole assembly 202.

Figure 4:
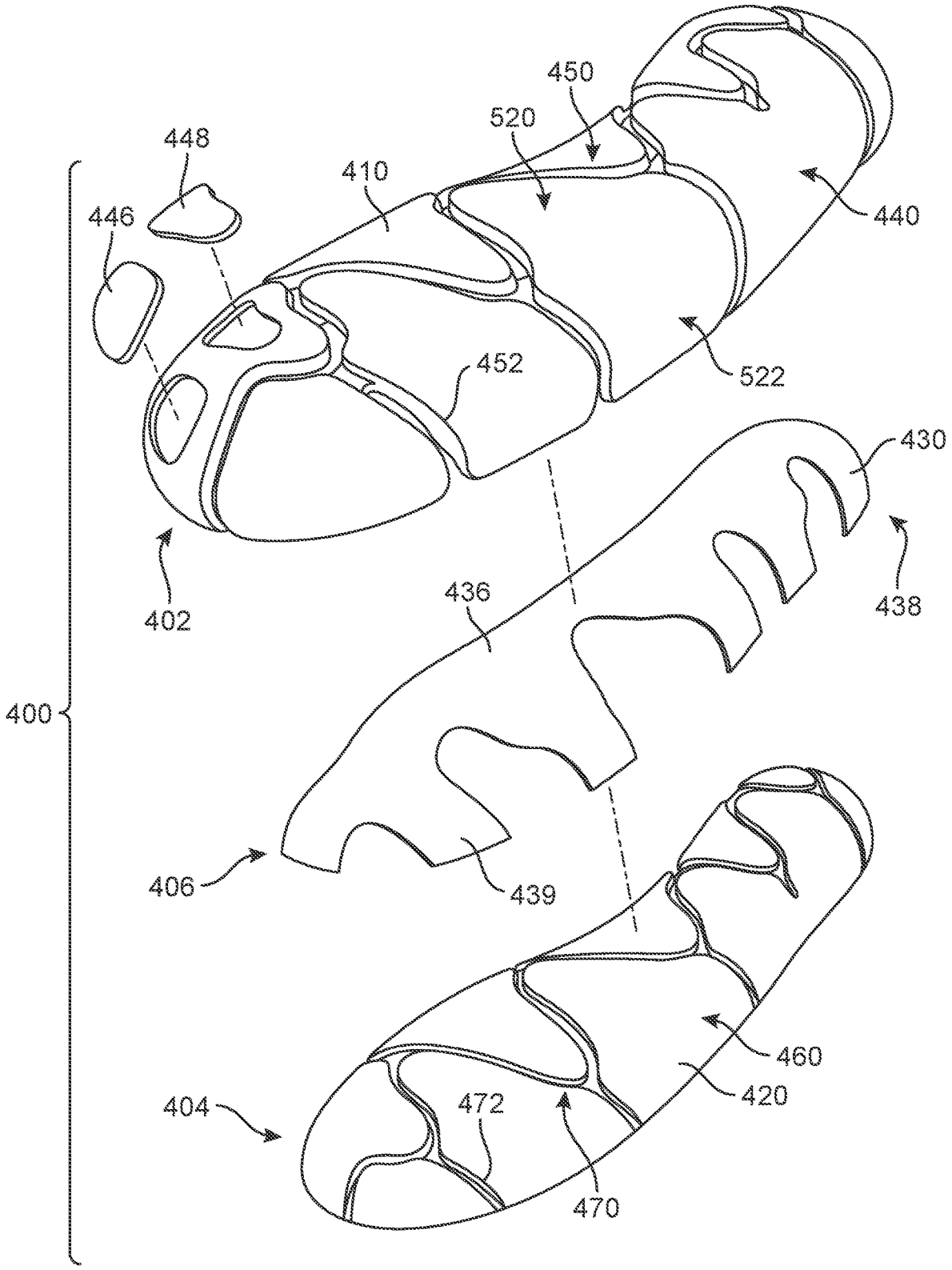
FIG. 4 is an exploded isometric view of an embodiment of a sole system.

FIG. 4 is a schematic bottom exploded isometric view of another embodiment of a sole system 400. Sole system 400 may be similar to sole system 104 shown in FIGS. 1-3 and may include similar components and provisions. It may be appreciated that any provisions of sole system 400 could be used with sole system 104 and vice versa.

FIGS. 5-8 illustrate various schematic views of sole system 400. Referring now to FIGS. 4-8, sole system 400 includes an outer sole assembly 402, a middle sole assembly 404 and an intermediate layer 406. Outer sole assembly 402 includes an outer surface 410, which may be a ground contacting surface, and an inner surface 412 disposed opposite of outer surface 410. Likewise, middle sole assembly 404 includes an outer surface 420 and an inner surface 422 disposed opposite of outer surface 420. Additionally, intermediate layer 406 includes an outer surface 430 and an opposite inner surface 432.

Figure 5:
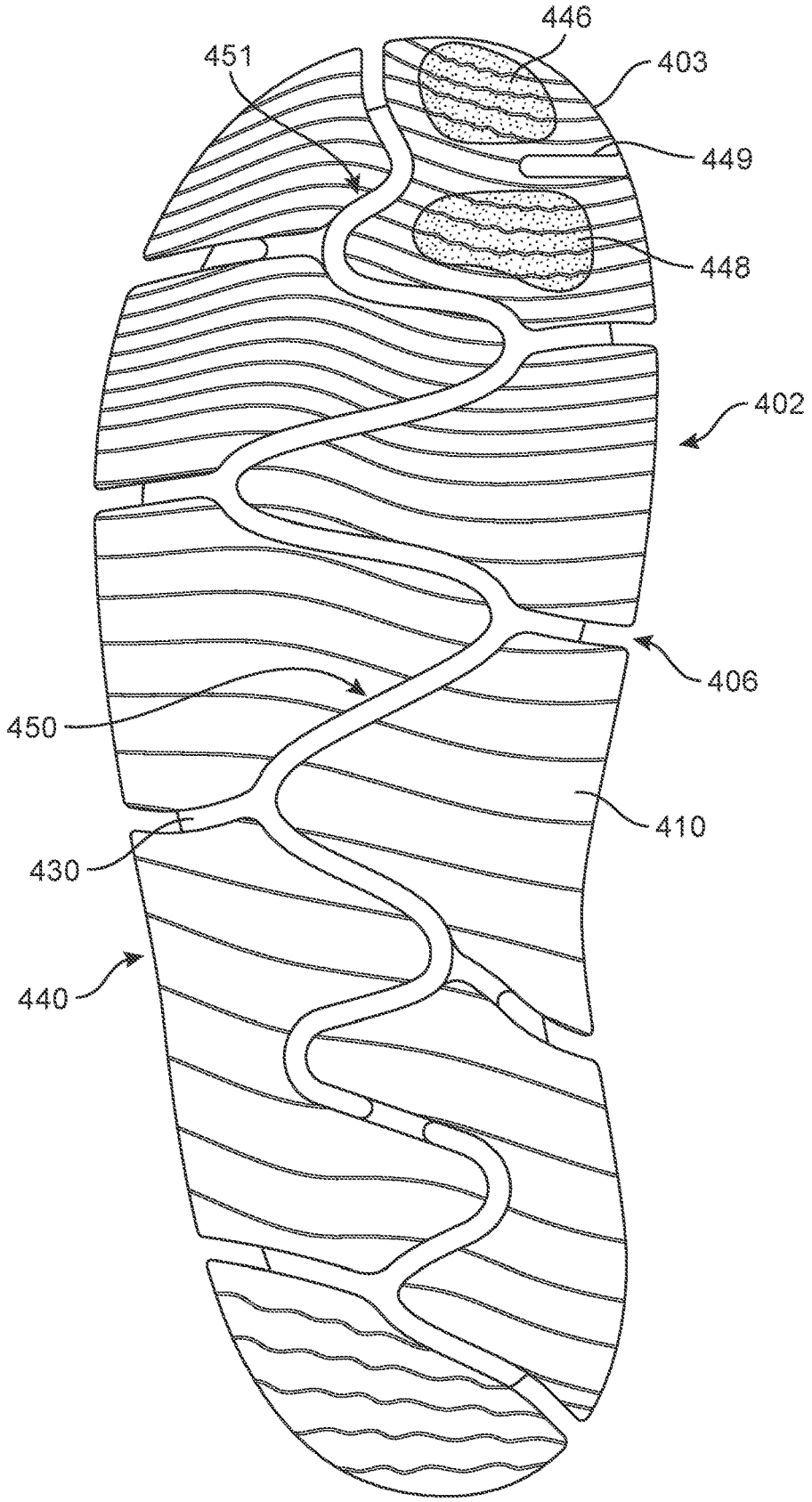
FIG. 5 is a schematic bottom view of a sole system according to an embodiment.
Figure 6:
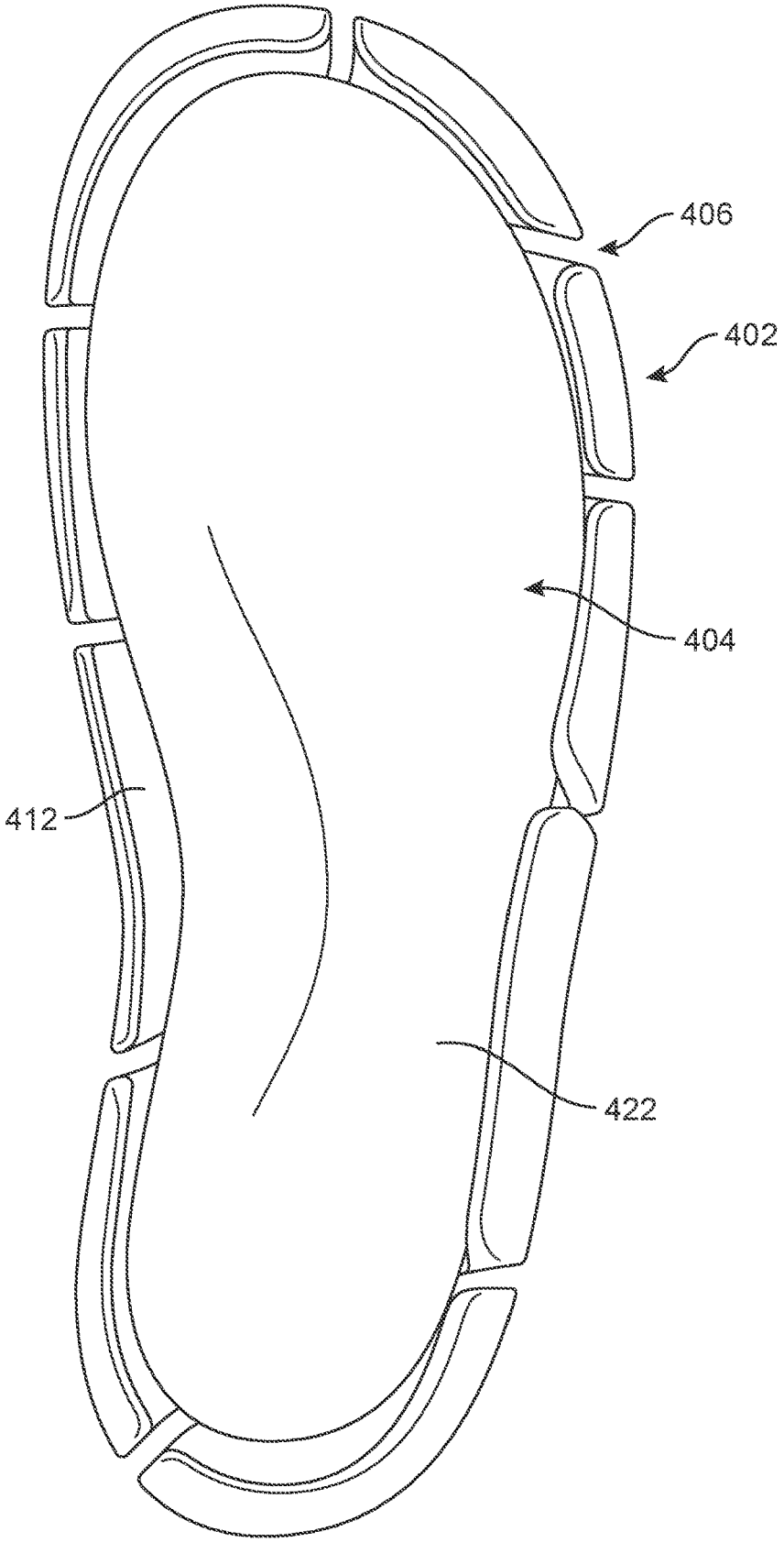
FIG. 6 is a schematic top view of a sole system according to an embodiment.

Referring to FIGS. 4-5, outer sole assembly 402 is comprised of a plurality of outer sole members 440 that are arranged in an interdigitated configuration. Moreover, plurality of outer sole members 440 are spaced apart by set of gaps 450. Similarly, middle sole assembly 404 is comprised of plurality of middle sole members 460 that are arranged in an interdigitated configuration. Moreover, plurality of sole members 460 are spaced apart by set of grooves 470.

In some embodiments, one or more of outer sole members 440 can include provisions to improve traction. In some embodiments, a forwardly disposed outer sole member 440 can also include a first tread pad 446 and a second tread pad 448. The use of first tread pad 446 and second tread pad 448 may enhance grip during motions where the foot leads off from the toes. And the positioning of a peripheral gap 449 partially between first tread pad 446 and second tread pad 448, along with positioning second tread pad 448 adjacent a segment of a forward central gap 451 may increase flexibility and allow the medial forward edge 403 of sole system 400 to better adapt to bending of a big toe.

Figure 7:
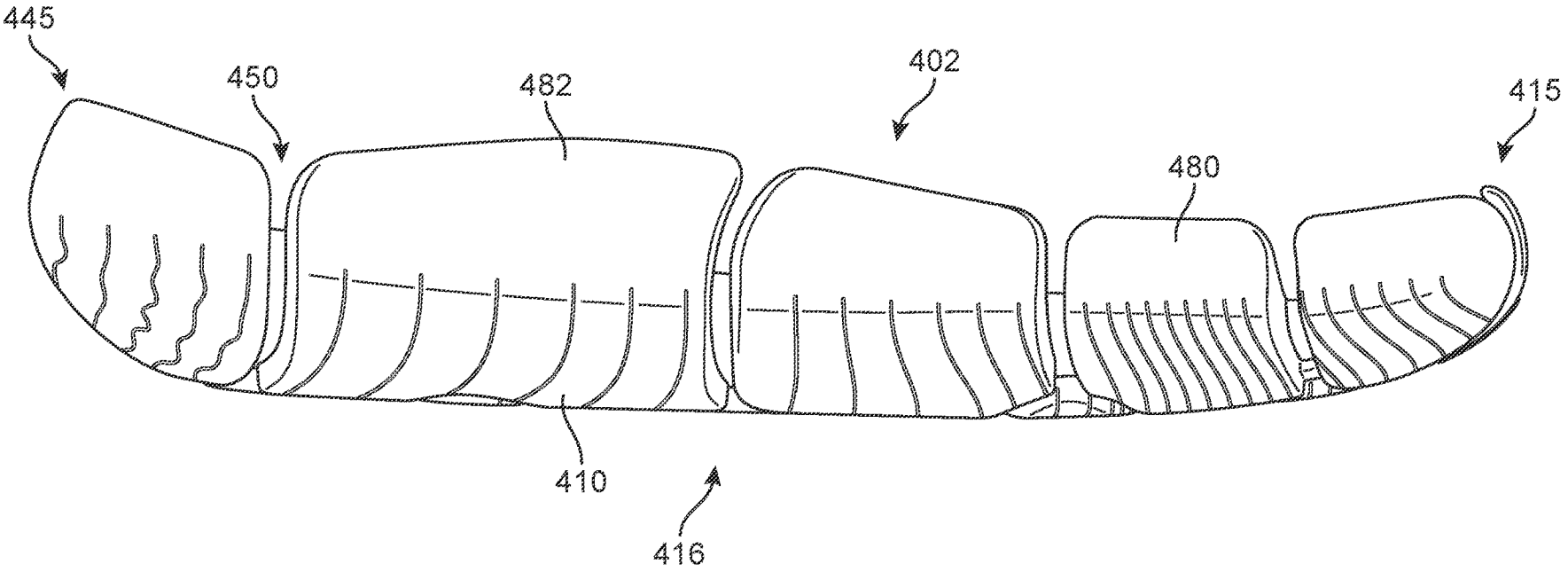
FIG. 7 is a schematic view of a lateral side of a sole system according to an embodiment.
Figure 8:
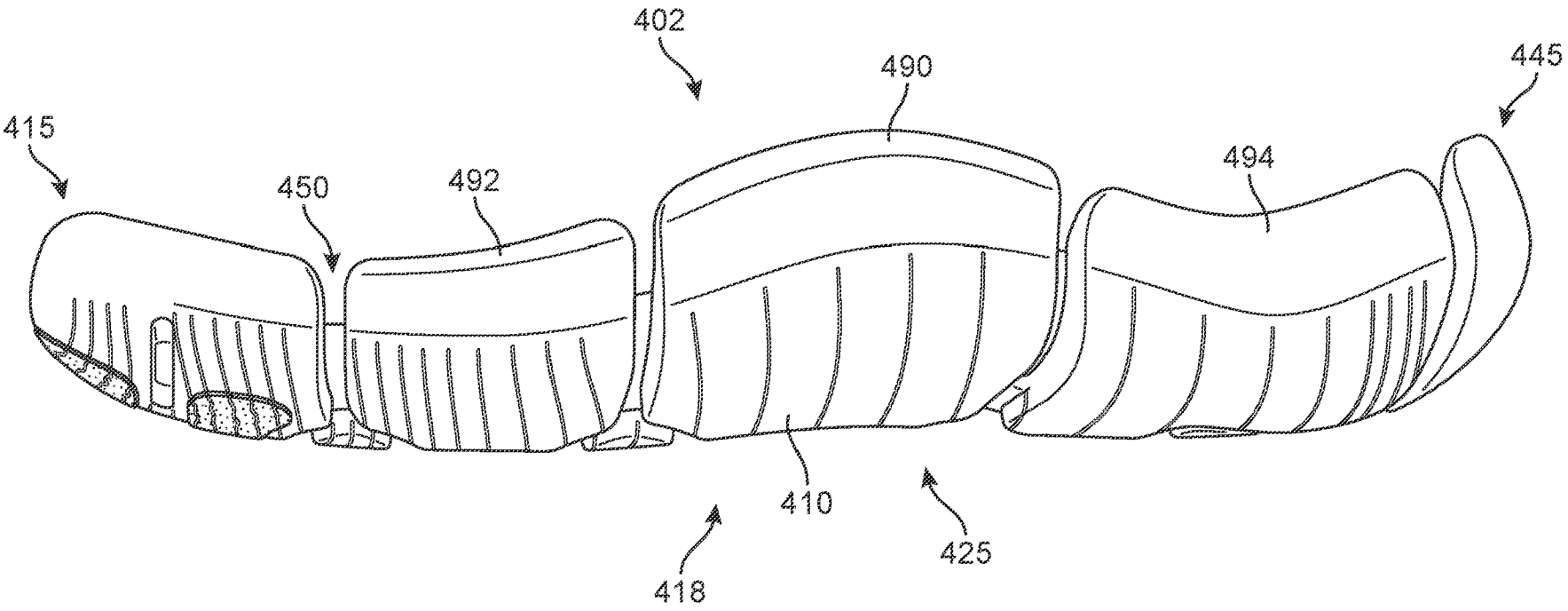
FIG. 8 is a schematic view of a medial side of a sole system according to an embodiment.

In some embodiments, the geometry of the peripheral portions of each outer sole member can vary to achieve desired support on the sides, as well as front and back, of a foot. In the exemplary embodiment, as best seen in FIGS. 7-8, the relative heights of each of plurality of outer sole members 440 may generally increase from forefoot region 415 to heel region 445 of sole system 400 on lateral side 416. Thus an outer sole member 480 that is disposed forwards of an outer sole member 482 on lateral side 416 is shorter in height. On medial side 418, the height may be greatest in midfoot region 425 to accommodate the arch of the foot. Thus an outer sole member 490 that is disposed in midfoot region 425 may have a greater height than either of outer sole member 492 or outer sole member 494, which are disposed forwards and rearwards from outer sole member 490, respectively.

As best seen in FIG. 4, intermediate layer 406 has a shape that is different from intermediate layer 206 of sole system 104 of FIGS. 1-3. In particular, intermediate layer 406 comprises a continuous medial side 436 with several finger-like portions 438 extending towards a lateral side of sole system 400. In at least some embodiments, these portions 438 may be vertically aligned with corresponding gaps and/or grooves in set of gaps 450 and set of grooves 470. As one example, a portion 439 of intermediate layer 406 may be vertically aligned with a groove segment 472 in set of grooves 470 and a gap segment 452 in set of gaps 450. This ensures that intermediate layer 406 may span the spaces between adjacent sole members in both outer sole assembly 402 and middle sole assembly 404. Of course in other embodiments, intermediate layer 406 could have any other shape. Moreover, in some other embodiments, portions of an intermediate layer could be aligned with some gaps and/or grooves, while other gaps and/or grooves may not be associated with any portions of the intermediate layer. Thus, an intermediate layer can be selectively applied to various locations within a sole system.

The use of gaps and grooves within the outsole assemblies may help facilitate improved adaptation of a sole system to a foot. Specifically, the individual sole members (in both the outer sole assembly and the middle sole assembly) can be individually articulated because of their separation by flex gaps or grooves. These provisions further facilitate an adaptive fit during use, as the separate sole members can adaptively flex to new configurations of the foot as it is bent, flexed or otherwise moved during use.

Embodiments can include further provisions for adapting to a foot, especially for adapting to the change in the dimensions and shape of the foot during impact with the ground. Some embodiments can include provisions that help increase the dimensions of a sole system, including the length and/or width, in a dynamic manner to accommodate dynamic changes in the foot.

As clearly shown in FIGS. 4-8, sole system 400 is configured to have a contoured geometry. This geometry may also be referred to as a 'rocker' geometry, in which the first point of contact with the ground may be the center of the sole. Specifically, outer surface 410 of outer sole assembly 402 has a convex shape, while inner surface 422 of middle sole assembly 404 together with inner surface 412 of outer sole assembly 402 comprise a concave shape for receiving a foot. This geometry provides a sole system in which a central region 520 (extending along the length of sole system 400) is the initial and primary contact region with the ground until enough force is applied to push peripheral region 522 (extending on both the lateral and medial sides of sole system 400) down against the ground surface.

Figure 9:
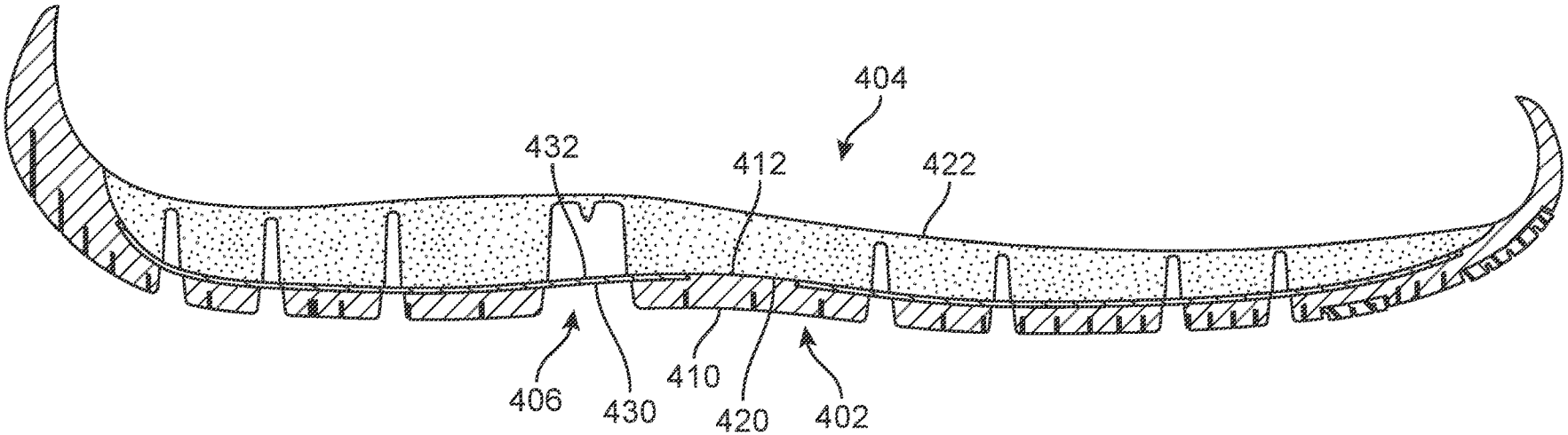
FIG. 9 is a schematic longitudinal cross-sectional view of an embodiment of a sole system.

FIG. 9 illustrates a longitudinal cross-sectional view of sole system 400 according to an embodiment. Referring to FIG. 9, outer surface 430 of intermediate layer 406 may be disposed against inner surface 412 of outer sole assembly 402. Additionally, inner surface 432 of intermediate layer 406 may be disposed against outer surface 420 of middle sole assembly 404. Thus, intermediate layer 406 is generally disposed between middle sole assembly 404 and outer sole assembly 402 in most regions of sole system 400. However, in some regions members of middle sole assembly 404 and of outer sole assembly 402 could be in direct contact. For example, in enlarged cross-section of region 500 in FIG. 10, a side peripheral surface portion 503 of a middle sole member 519 is in direct contact with outer sole member 504.

In different embodiments, different components of a sole system may be fixedly attached or decoupled. In some embodiments, intermediate layer 406 may be fixedly attached (e.g., bonded) to both middle sole assembly 404 and outer sole assembly 402. In other embodiments, however, intermediate layer 406 may only be bonded to outer sole assembly 402 and intermediate layer 406 could 'float' or otherwise remain unattached to either intermediate layer 406 or outer sole assembly 402. In some cases, intermediate layer 406 could be strongly bonded with outer sole assembly 402 while being lightly bonded (lightly tacked) to middle sole assembly 404.

Figure 10:
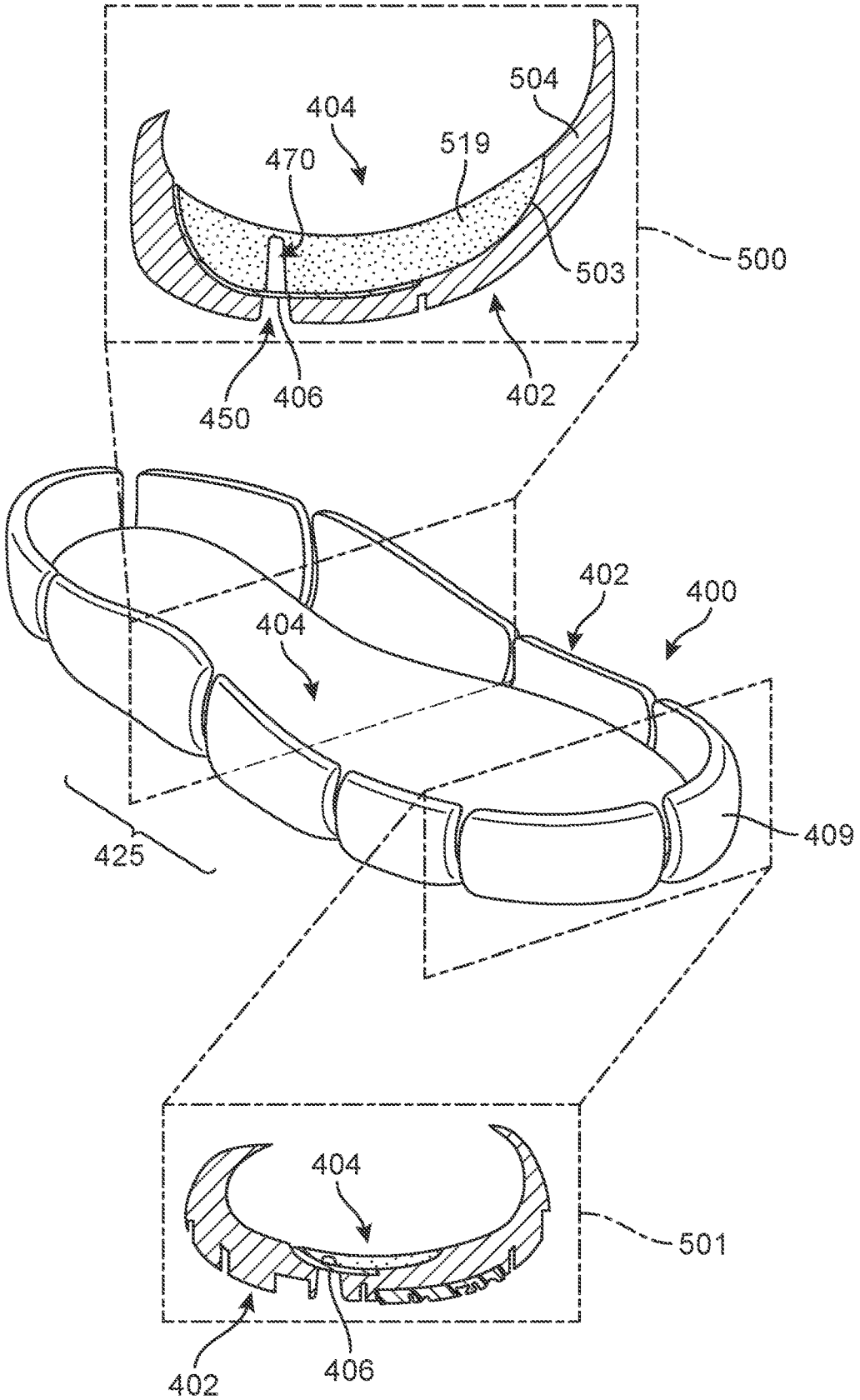
FIGS. 10-13 are schematic views of a sole system including an enlarged lateral cross-sectional view.
Figure 11:
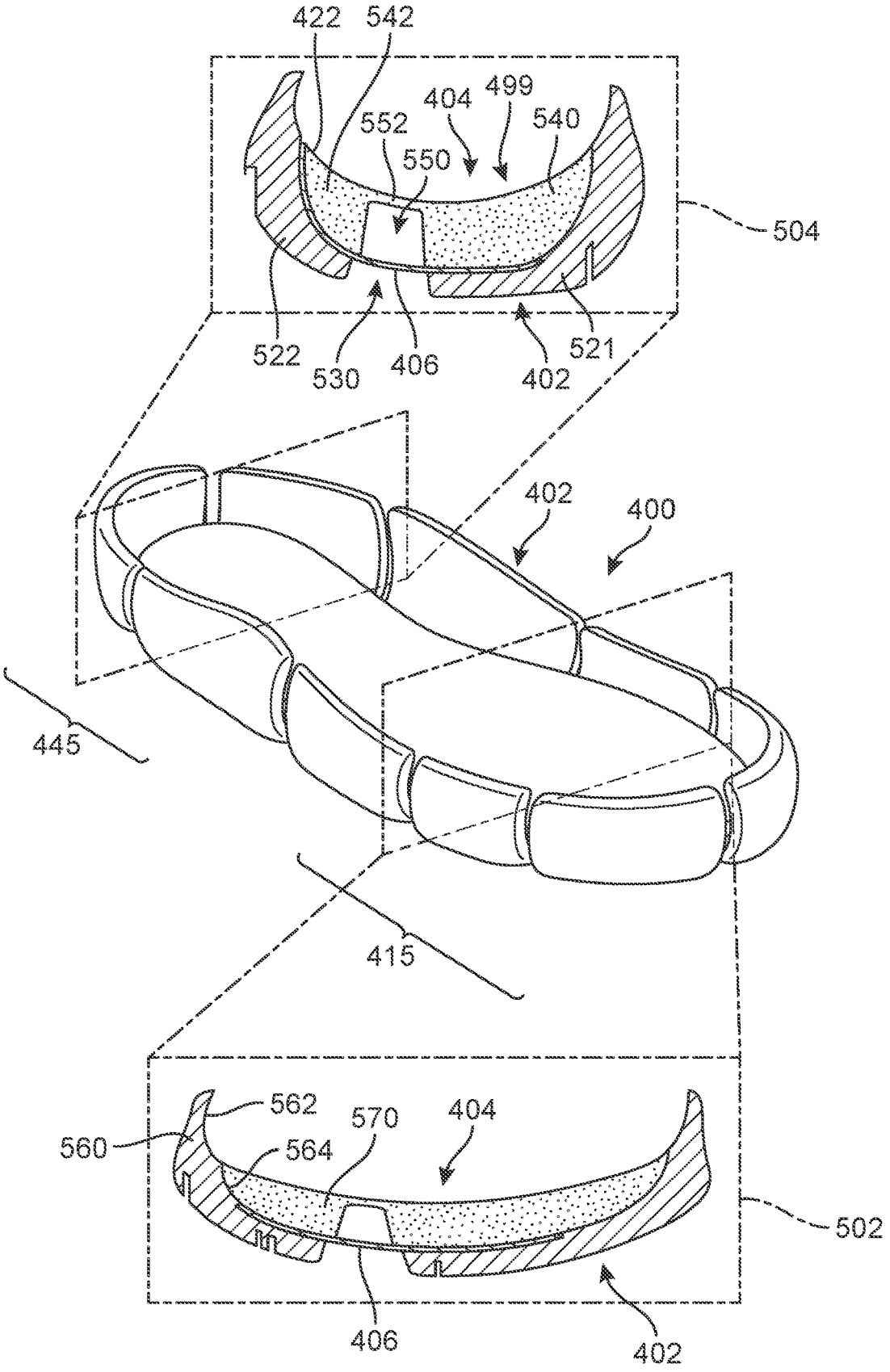
Figure 12:
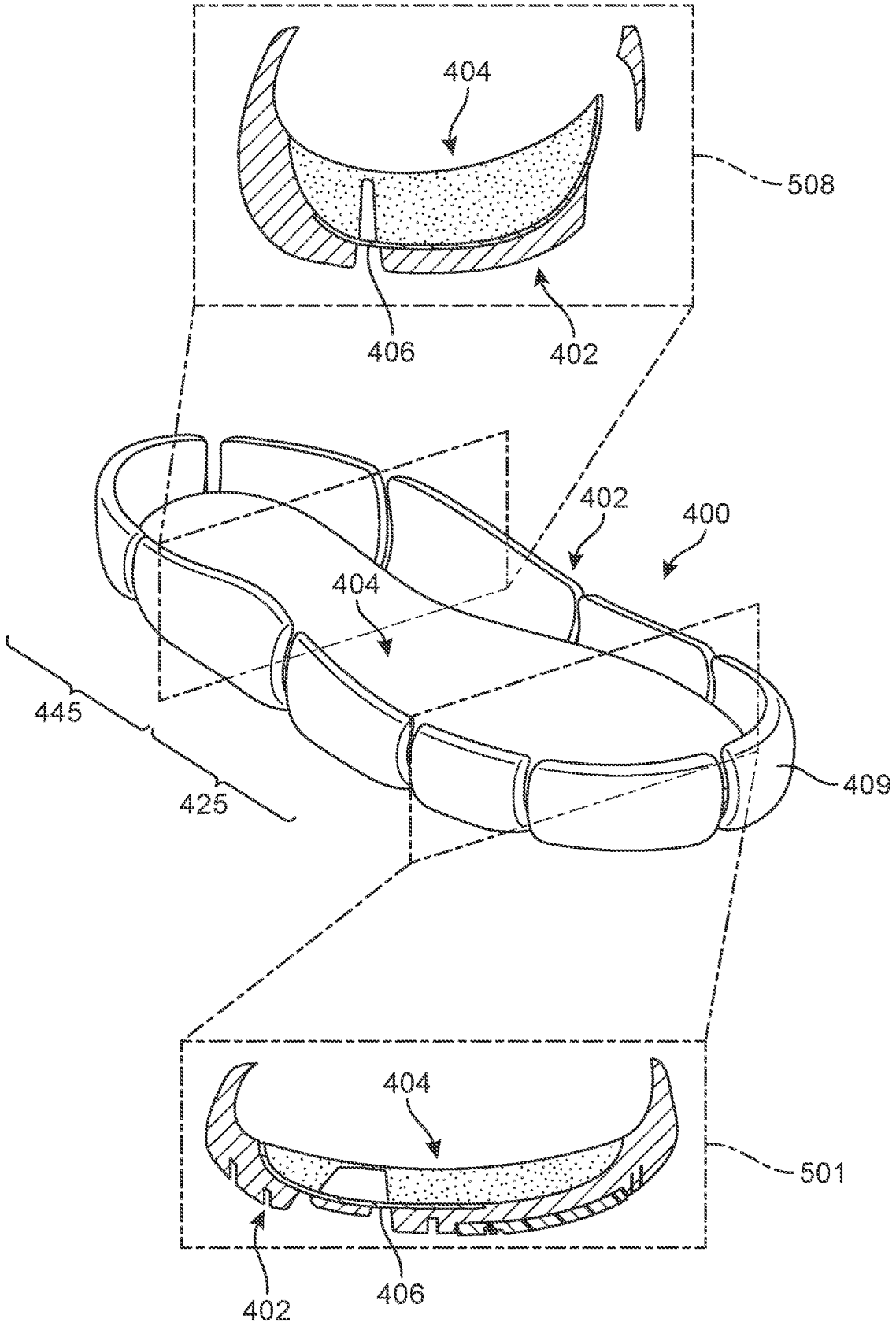
Figure 13:
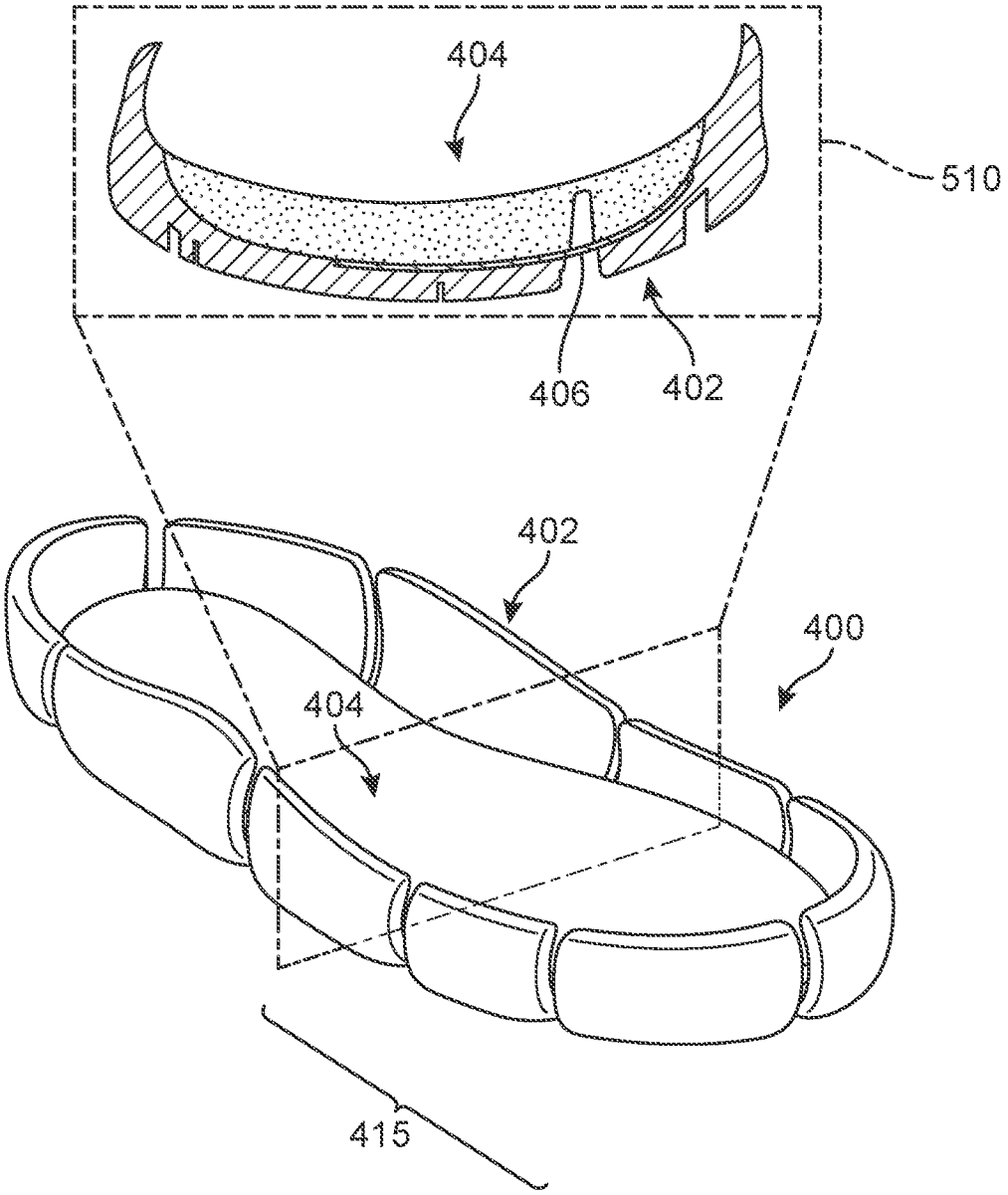

FIGS. 10-13 illustrate various enlarged cross-sectional views of sole system 400 taken at different longitudinal regions, according to an embodiment. Specifically, FIG. 10 shows an enlarged cross-sectional view of longitudinal region 501, which is disposed near a forward edge 409 of sole system 400, as well as an enlarged cross-sectional view of longitudinal region 500, which is disposed in midfoot region 425 of sole system 400. FIG. 11 shows an enlarged cross-sectional view of longitudinal region 502, which is disposed in forefoot region 415, as well as an enlarged cross-sectional view of longitudinal region 504, which is disposed in heel region 445 of sole system 400. FIG. 12 shows an enlarged cross-sectional view of longitudinal region 508, which is disposed near a forward edge 409 of sole system 400, as well as an enlarged cross-sectional view of longitudinal region 508, which is disposed proximate midfoot region 425 and heel region 445 of sole system 400. Finally, FIG. 13 illustrates another cross-sectional view of longitudinal region 510 in forefoot region 415 of sole system 400.

FIGS. 10-13 clearly show that set of gaps 450 divide outer sole assembly 402 into opposing and spaced apart lateral and medial outer sole members. For example, in longitudinal region 504, shown in FIG. 11, medial outer sole member 521 is spaced apart from lateral outer sole member 522 by central gap 530. Likewise, set of grooves 470 divide middle sole assembly 404 into spaced apart lateral and medial middle sole members. For example, in longitudinal region 504, medial middle sole member 540 is spaced apart from lateral middle sole member 542 by central groove 550. Moreover, medial middle sole member 540 and lateral middle sole member 542 are partially connected at inner surface 422 of middle sole assembly 404 by webbed portion 552.

As previously discussed, in some embodiments outer sole members of an outer sole assembly can include recessed portions that receive an intermediate layer and/or middle sole members. Referring to FIGS. 10-13, outer sole assembly 402 is seen to include recessed portions that are shaped to fit intermediate layer 406 and middle sole members of middle sole assembly 404 such that middle sole assembly 404 and outer sole assembly 402 form a flush concave inner surface for sole system 400. As an example, referring to the enlarged cross-sectional view of longitudinal region 502 shown in FIG. 11, outer sole member 560 is seen to have a first inner curved surface region 562 and a second inner curved surface region 564, where the curvature changes abruptly between the two regions. Second inner curved surface region 564 corresponds to a recessed region of outer sole member 560, which is sized and shaped to fit a portion of intermediate layer 406 as well as middle sole member 570. In a similar manner, at least some of the remaining outer sole members of outer sole assembly 402 have similar recessed regions that fit intermediate layer 406 and/or a corresponding middle sole member. This arrangement provides a continuous and smooth inner concave surface 499 (see FIG. 11) for the entire length of sole system 400.

FIGS. 10-13 also clearly demonstrate the convex geometry of the outer surface of sole system 400 and the concave geometry of the inner surface of sole system 400. In some cases, this gives sole system 400 a bow-like lateral cross-sectional shape, or C-like shape, at some locations. Moreover, the degree of curvature varies along the length of sole system 400 to adapt to variations in geometry along the length of a foot. Specifically, the concave inner surface is designed so that sole system 400 hugs or wraps snugly against the bottom of the foot in an unloaded condition (i.e., with little or no ground contact forces). The outer convex surface of sole system 400 provides space on the lateral and medial sides for sole system 400 to deform and flatten out, thereby increasing the effective width of sole system 400 to accommodate a similar change in width of the foot as sufficient loads are applied.

In different embodiments, the material properties of one or more components of a sole system could vary. In some embodiments, it may be desirable to have outer sole members comprising materials that are durable. Also, it may be desirable to have the middle sole members comprising materials that facilitate cushioning, and are therefore sufficiently compressible. To this end, some embodiments may use various kinds of foams for the middle and outer sole members. Exemplary foams that could be used for middle and/or outer sole members include, but are not limited to, ethyl vinyl acetate (EVA foam), Phylon (or other compression molded foams), polyurethane, rubber, as well as various combinations of these foams. In one embodiment, middle sole members could be made of a material including soft dampened polyurethane. In one embodiment, outer sole members could be made of a material including injected unit (IU) foam.

Figure 14:
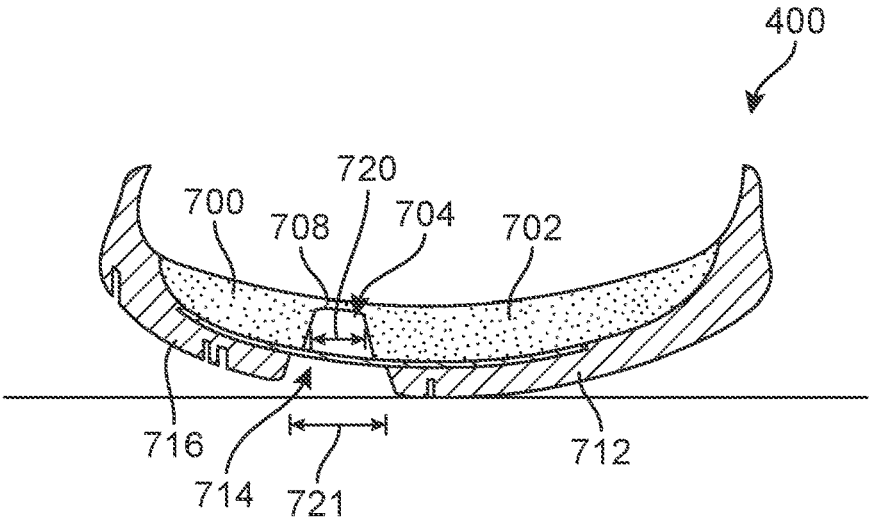
FIG. 14 is a schematic cross-sectional view of a portion of a sole system in an unloaded condition.
Figure 15:
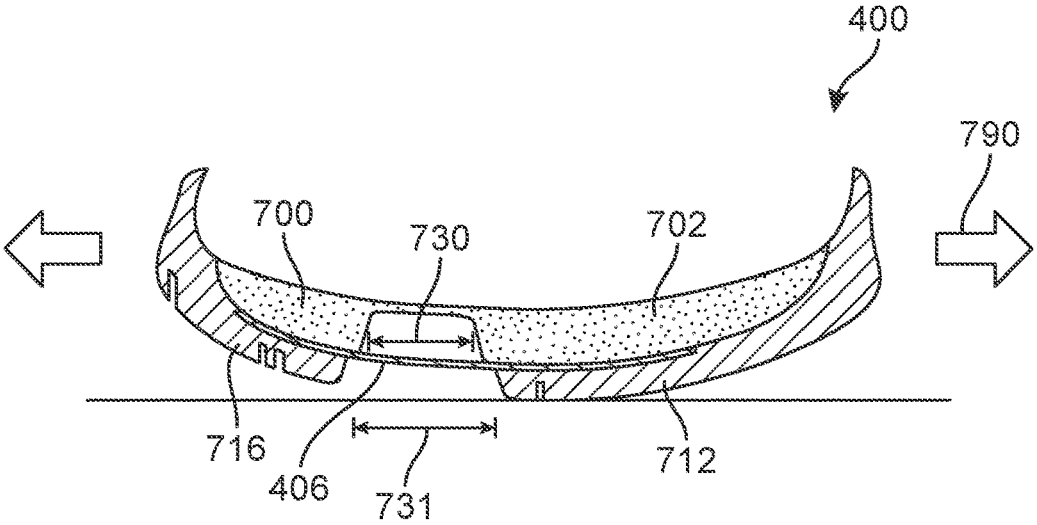
FIG. 15 is a schematic cross-sectional view of a portion of a sole system in a loaded condition.

In some embodiments, intermediate layer 206 may be configured as an elastic layer. In particular, intermediate layer 206 may be more elastic than the sole members of either middle sole assembly 204 or outer sole assembly 202. To this end, the intermediate layer 206 has a different material composition than either the middle sole assembly 204 or the outer sole assembly 202. Exemplary materials for intermediate layer 206 can include, but are not limited to, various elastic films, plastics, textile layers or other materials. In one embodiment, intermediate layer 206 comprises a thermoplastic polyurethane (TPU) membrane. In some cases, intermediate layer 206 could be molded. In other cases, intermediate layer 206 could be flat sheet die-cut. Using an elastic layer between outer sole assembly 202 and middle sole assembly 204 may facilitate stretching and flexibility along the gaps and grooves between adjacent sole members. Using an elastic, or stretchy, material for intermediate layer 206 allows intermediate layer 206 to provide stretch and recovery in a similar manner to a tendon in the body. Thus, intermediate layer 206 is more elastic than the middle sole assembly 204 outer sole assembly 202 to facilitate stretching and flexibility along the gaps and grooves between adjacent sole members and FIGS. 14 and 15 illustrate schematic cross-sectional views of a portion of sole system 400 as lateral tensions are applied, according to an embodiment. In a neutral or unloaded configuration, shown in FIG. 14, a lateral midsole member 700 and a medial midsole member 702 are spaced apart by a distance 720 corresponding with the width of groove 704, except at inner surface 422 where lateral midsole member 700 and medial midsole member 702 are attached by webbed portion 708. Similarly, a lateral outer sole member 716 and a medial outer sole member 712 are likewise spaced apart by distance 721 that corresponds with the width of gap 714.

Referring now to FIG. 15, as lateral tension 790 is applied to the lateral and medial sides of sole system 400, both intermediate layer 406 and webbed portion 708 are stretched laterally, which increases the separation distance between adjacent sole members. Specifically, in the loaded configuration, lateral midsole member 700 and medial midsole member 702 are spaced apart by distance 721, which is greater than distance 720. Likewise, lateral outer sole member 716 and medial outsole member 712 are spaced apart by a distance 731, which is greater than distance 730. This may result results in a net increase in the overall width of sole system 400 between the neutral (unloaded) and loaded configurations.

As seen by comparing FIGS. 14 and 15, while intermediate layer 406 and webbed portion 708 both undergo stretching, the separate midsole members and outsole members do not generally stretch themselves, according to the present embodiment. Thus the relative material properties like cushioning, strength, support, etc., as well as the average thickness, of each sole member may be retained under this kind of stretching of the overall sole system.

Although the embodiment shown in FIGS. 14-15 depicts widthwise stretching, a similar type of stretching could occur in a lengthwise direction of sole system 400, as portions of set of gaps 450 and set of grooves 470 are oriented at least partially in a lateral direction and could thereby facilitate expansion/extension in a lengthwise direction.

In some embodiments, a webbed portion may stretch significantly more than adjacent portions of a sole assembly because the webbed portion may be significantly thinner than adjacent portions. In one embodiment, for example, a webbed portion could have a thickness of approximately 0.5 mm. Alternatively, in some other embodiments, webbed portions could be formed from distinct materials than adjacent portions, including materials with higher degrees of elasticity.

It may be appreciated that in some embodiments a sole system may not stretch much in a widthwise direction due to expansion at the gaps/grooves. For example, depending upon the degree of elasticity selected for the intermediate layer, in some cases, the present structure may function more to facilitate flexing and bending at the gaps/grooves, rather than pure stretching at these locations.

Figure 16:
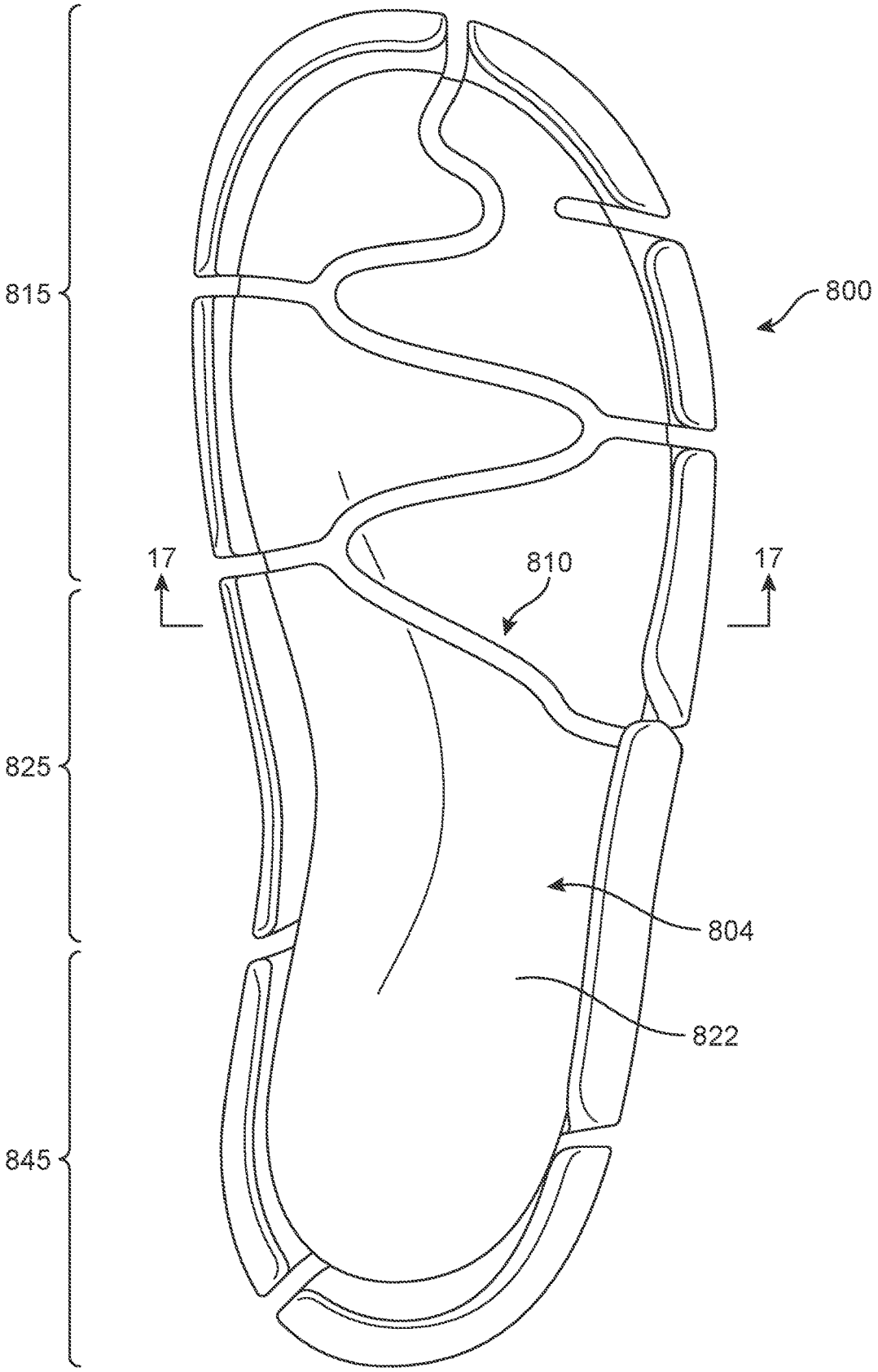
FIG. 16 is a schematic top down view of another embodiment of a sole system.
Figure 17:
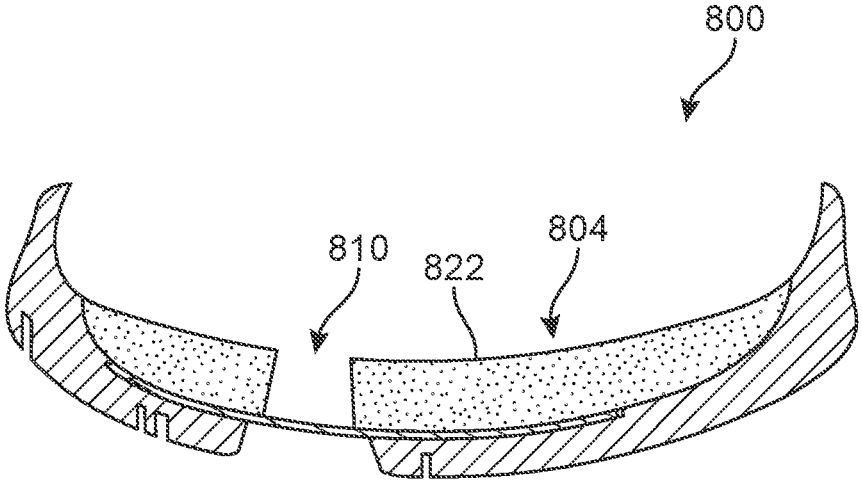
FIG. 17 is a cross-sectional view of a portion of the sole system of FIG. 16.

FIGS. 16-17 are schematic views of an alternative embodiment of a sole system 800. Sole system 800 may be similar in at least some ways to sole system 400 and to sole system 104. Moreover, any features of sole system 800 may be used interchangeably with features of sole system 400 or sole system 104, and vice versa. In contrast to the previous embodiments, sole system 800 includes a middle sole assembly 804 with a set of gaps 810 that go through the entire thickness of middle sole assembly 804. In particular, gaps disposed in a forefoot region 815 and a midfoot region 825 extend through the entire thickness of middle sole assembly 804. In heel region 845, however, middle sole assembly 804 may use grooves (not shown) that do not extend all the way through to inner surface 822 of sole system 800. It may be appreciated that in different embodiments, the selection of gaps or grooves that only go partially through a middle sole member could vary. More specifically, gaps that go all the way through vs. grooves that do not could be selectively applied in various regions of a middle sole assembly, and also in an outer sole assembly, to achieve desired degrees of flexibility, stretching and/or other characteristics for a sole system.

Figure 18:
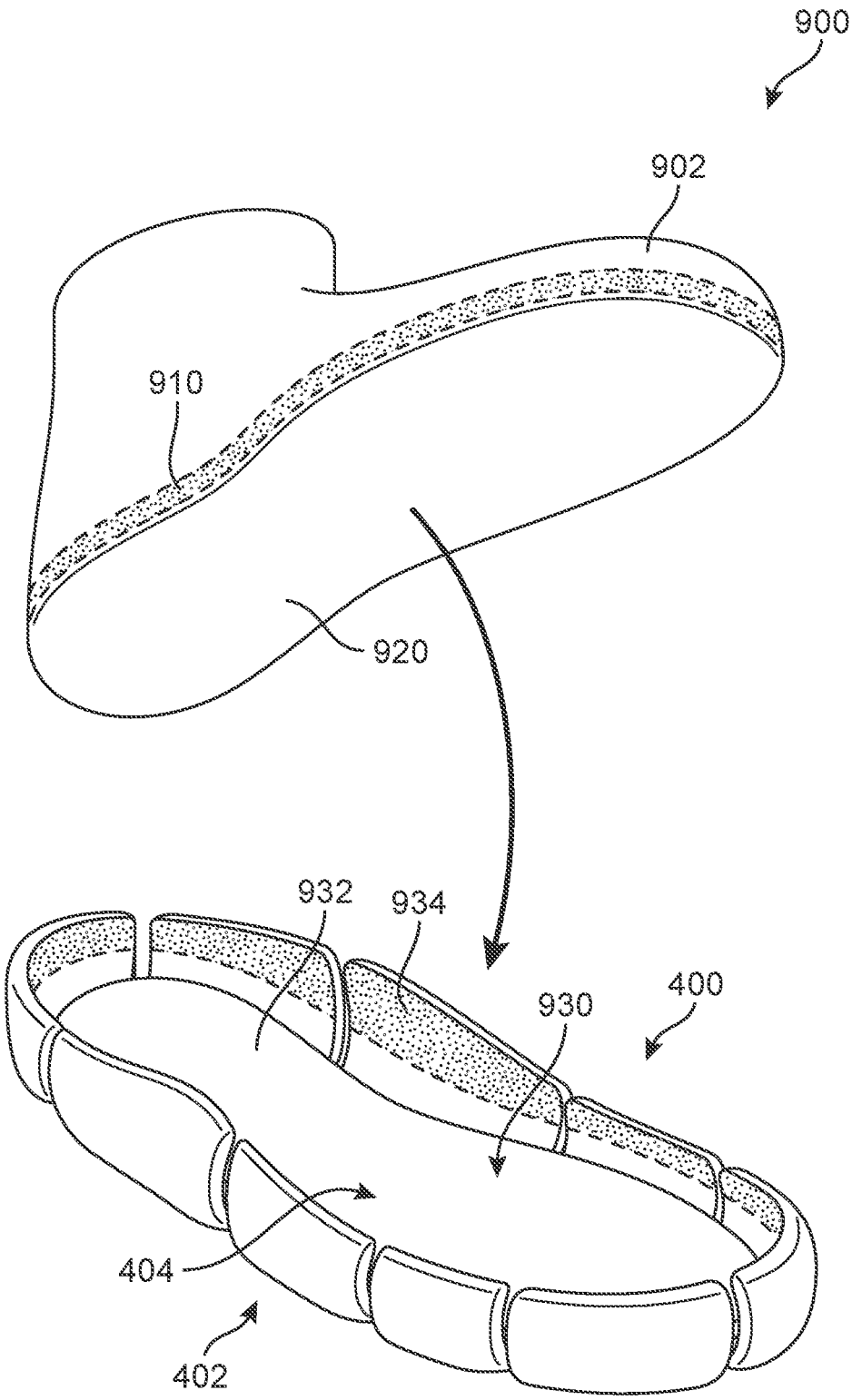
FIG. 18 is an exploded isometric view of an upper and a sole system, according to an embodiment.
Figure 19:
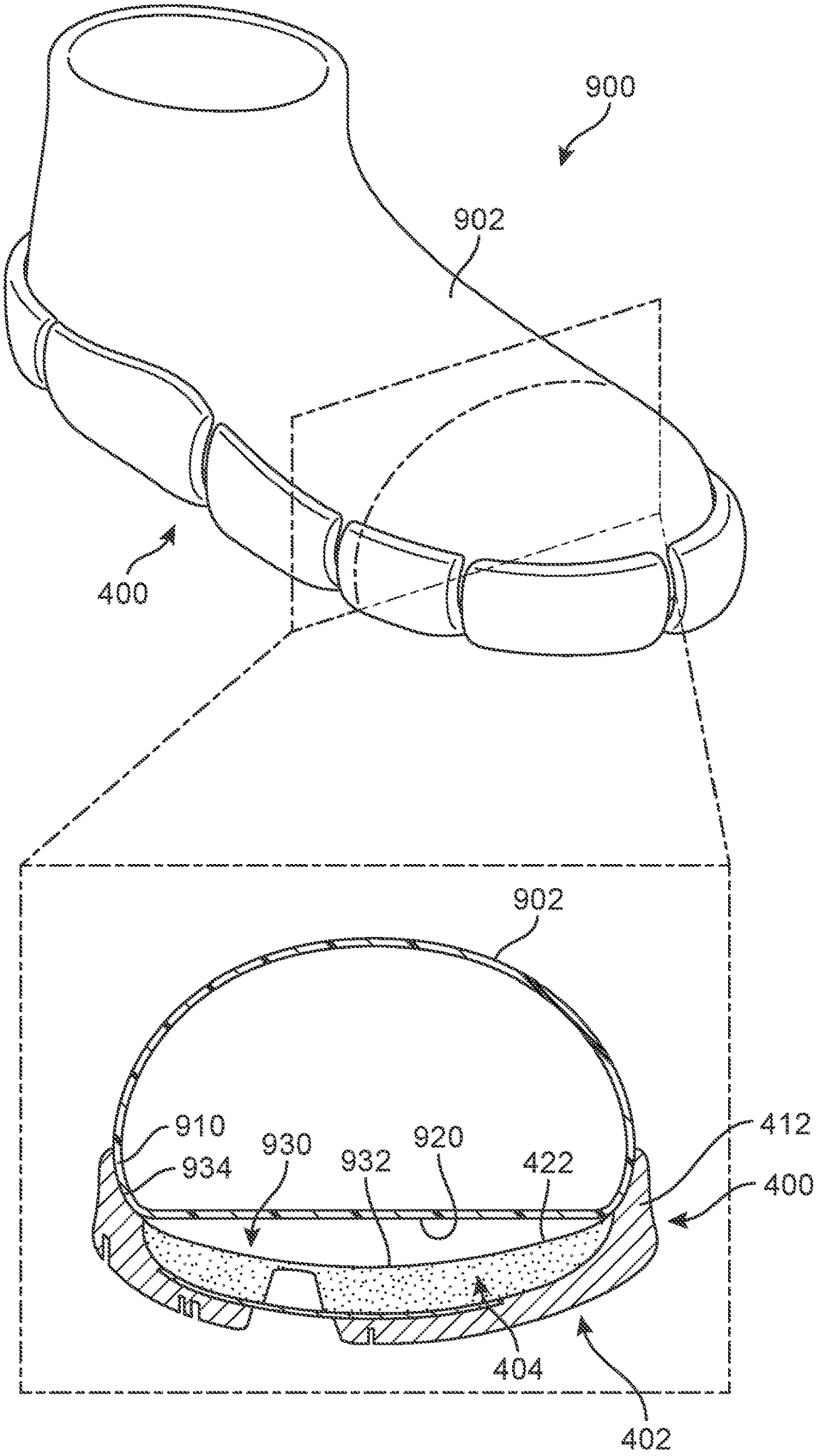
FIG. 19 is an isometric view of an article of footwear according to an embodiment, including an enlarged cross-sectional view of the article of footwear.

FIGS. 18 and 19 illustrate isometric schematic views of article 900, which comprises sole system 400 and a corresponding upper 902, according to an embodiment. In a similar manner to upper 102, discussed above and shown in FIGS. 1-3, upper 902 may be configured as a tension fit upper. As seen in FIGS. 18 and 19, upper 902 includes an attachment region 910. Attachment region 910 may be associated with a lower region of upper 902. Upper 902 may also include a bottom portion 920 that is bounded by attachment region 910. Bottom portion 920 may be a lower or bottom portion of upper 902.

As previously discussed, sole system 400 includes a concave inner surface 930. Concave inner surface 930 may be comprised of portions of inner surface 412 of outer sole assembly 402 as well as portions of inner surface 422 of middle sole assembly 404. Concave inner surface 930 may further be characterized by a central surface region 932 and a peripheral surface region 934. In the exemplary embodiment, central surface region 932 may approximately correspond with inner surface 422 of middle sole assembly 404 and peripheral surface region 934 may approximately correspond with inner surface 412 of outer sole assembly 402. However, in other embodiments, the central and peripheral surface regions need not correspond with the surfaces of an outer and middle sole assembly.

Attachment region 910 may be attached directly to peripheral surface region 934 of sole system 400. Embodiments may utilize any methods known in the art for attaching an upper and a sole structure. Exemplary methods include using adhesives, fasteners, stitching, welding or any other methods. In one embodiment, an adhesive is used to fixedly attach attachment region 910 of upper 902 with peripheral surface region 934 of sole system 400.

As best seen in FIG. 19, bottom portion 920 of upper 902 is unattached to central surface region 932. Moreover, in an unloaded state (i.e., a state without a foot or other source applying force down and against bottom portion 920), bottom portion 920 is held in tension over central surface region 932 and moreover is spaced apart from central surface region 932.

In some embodiments, the geometry of bottom portion 920 in an unloaded state (with no foot in the upper) may be generally flat, as in the embodiment shown in FIG. 19. In other embodiments, bottom portion 920 could have some curvature prior to being loaded. In each case, the curvature of bottom portion 920 may generally increase, or otherwise significantly change, in going from an unloaded to loaded condition as the foot is inserted.

Figure 20:
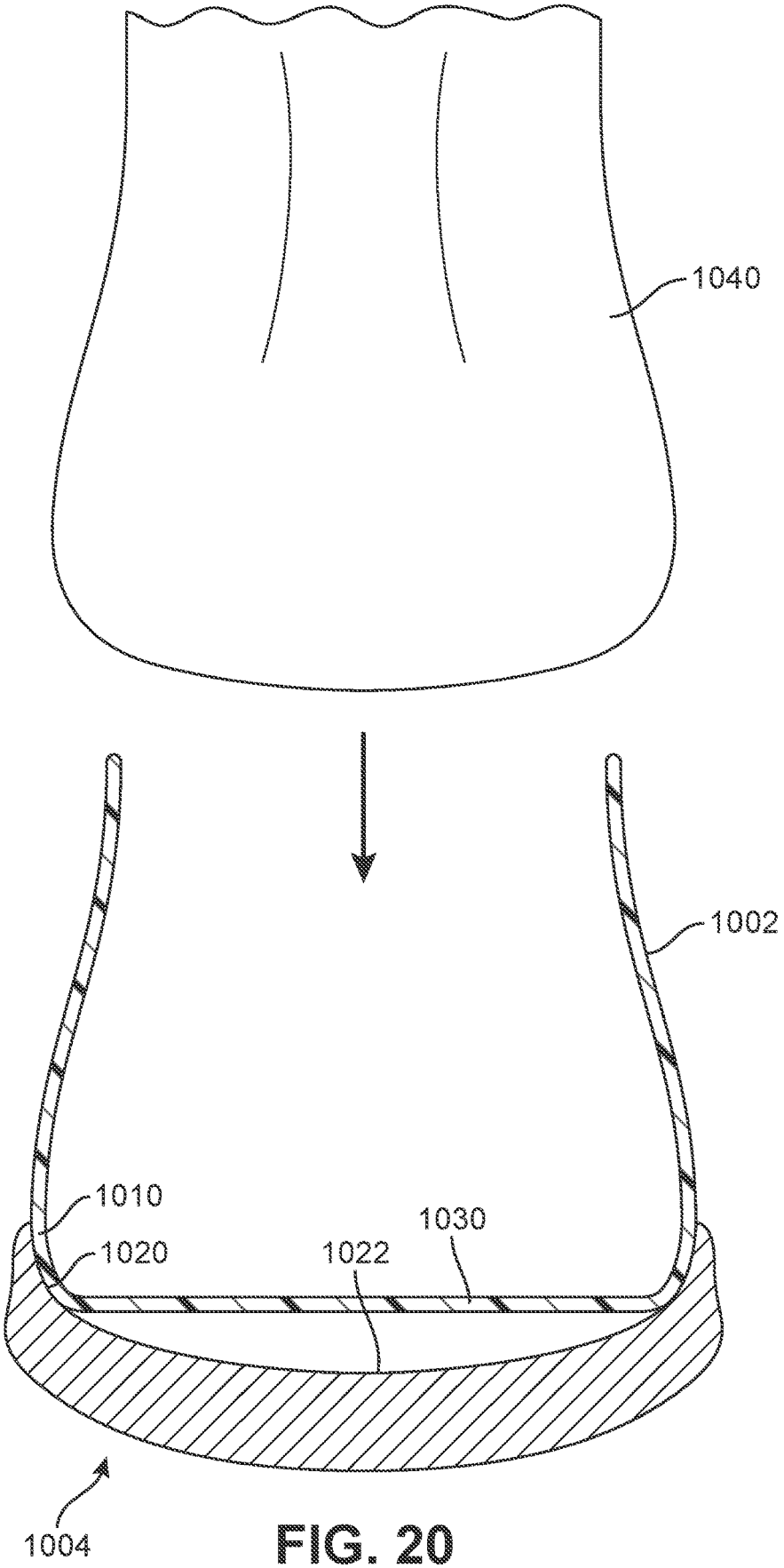
FIG. 20 is a schematic cross-sectional view of a sole with an upper attached to an inner peripheral surface region of the sole, according to an embodiment.
Figure 21:
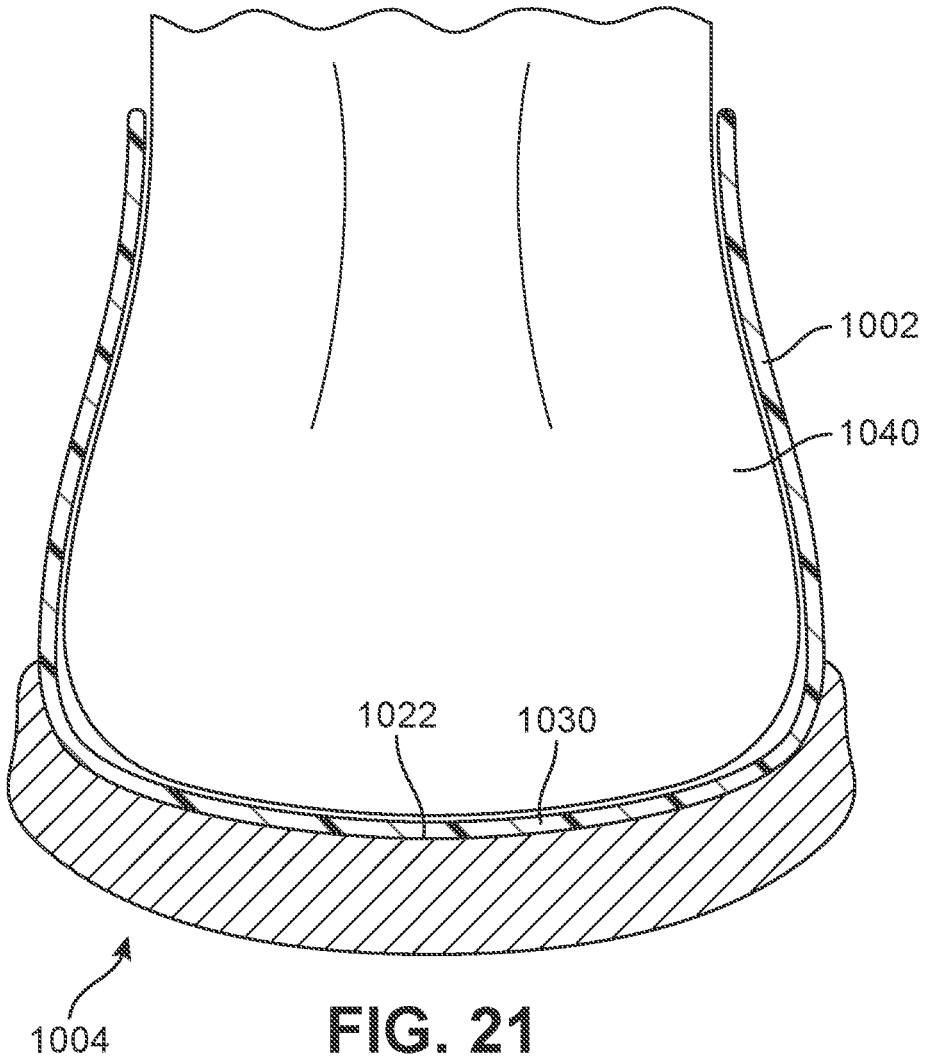
FIG. 21 is a schematic cross-sectional view of the sole and upper of FIG. 20 with a foot inserted, according to an embodiment.

FIGS. 20 and 21 are schematic cross-sectional views of an embodiment of an article of footwear 100 with a similar 'trampoline' configuration for an upper and sole system. Specifically, upper 1002 includes a similar peripherally located attachment region 1010 that is secured to an inner peripheral surface 1020 of sole system 1004. A bottom portion 1030 of upper 1002 is held in tension (i.e., is pulled taut) across a concave central inner surface 1022.

Prior to insertion of a foot 1040, as shown in FIG. 20, bottom portion 1030 has a generally flat geometry (i.e., low curvature). However, as foot 1040 is inserted, as shown in FIG. 21, foot 1040 may deform bottom portion 1030 so that both bottom portion 1030 and the bottom of foot 1040 are received within concave central inner surface 1022 of sole system 1004. This arrangement helps to keep bottom portion 1030 of upper 1002 taut against the bottom of foot 1040 at all times to ensure support and also reduce the feeling that the bottom of the foot has pulled away from the sole during some motions of the foot within the article.

In different embodiments, the material properties of upper 1002 and especially of bottom portion 1030 could vary. In some embodiments, bottom portion 1030 could have elastic properties and may be capable of stretching under loads. Moreover, the degree of elasticity could vary from one embodiment to another. Suitable materials for at least the bottom portion of an upper may be any materials that are generally elastic and capable of stretching or deforming when a sufficient load (e.g., a tensile load) is applied, including, but not limited to a load applied when a user inserts their foot into the void in the interior of the footwear, and/or when the user wearing the footwear places their foot on a ground surface and shifts some of their body weight onto the foot.

While the present embodiments of FIGS. 18-21 illustrate a closed upper with a bottom portion that is held in tension over the sole, other embodiments could include different kinds of material layers held in tension in a similar manner over the sole. In other embodiments, for example, a strobel layer or liner could be held in tension over a concave sole surface. In still other embodiments, an insole or other inner sole member could be held in tension over a concave sole surface. Other embodiments could include a similar configuration to that of the embodiments shown in FIGS. 18-21, but where the 'bottom portion' indicated in the figures is a layer of material that is discontinuous with the upper of the article. Moreover, the layer held in tension could be a textile layer, a polymer layer for example, comprising a thermoplastic polymer composition or a thermoset polymer composition, or could be comprised of any other suitable material. In some embodiments, a suitable material will generally have elastic properties.

Figure 22:
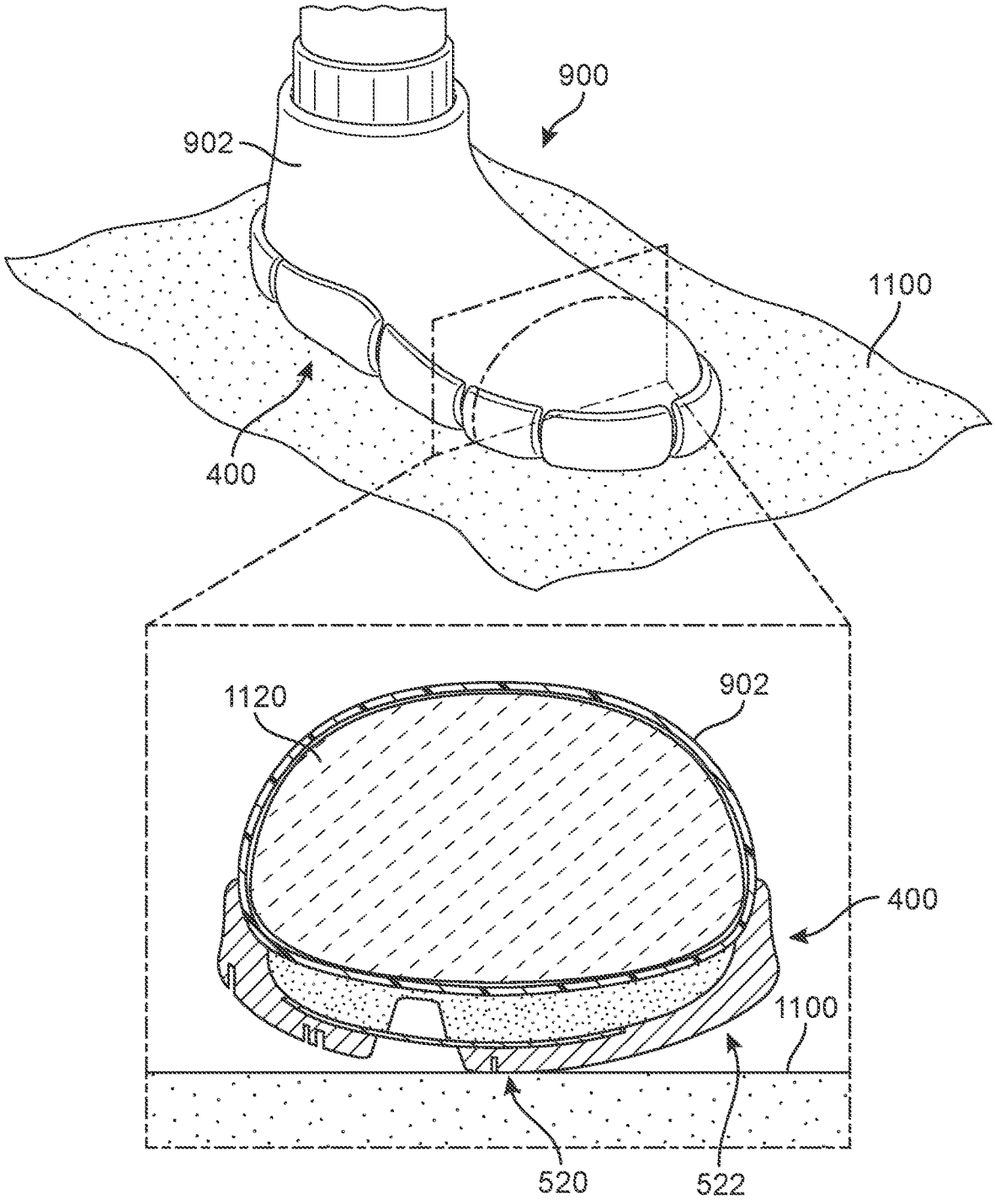
FIGS. 22-25 are schematic isometric views of an article of footwear including enlarged cross-sectional views of a sequence of motions in which the article of footwear comes into contact with the ground and then is raised off the ground, according to an embodiment.
Figure 23:
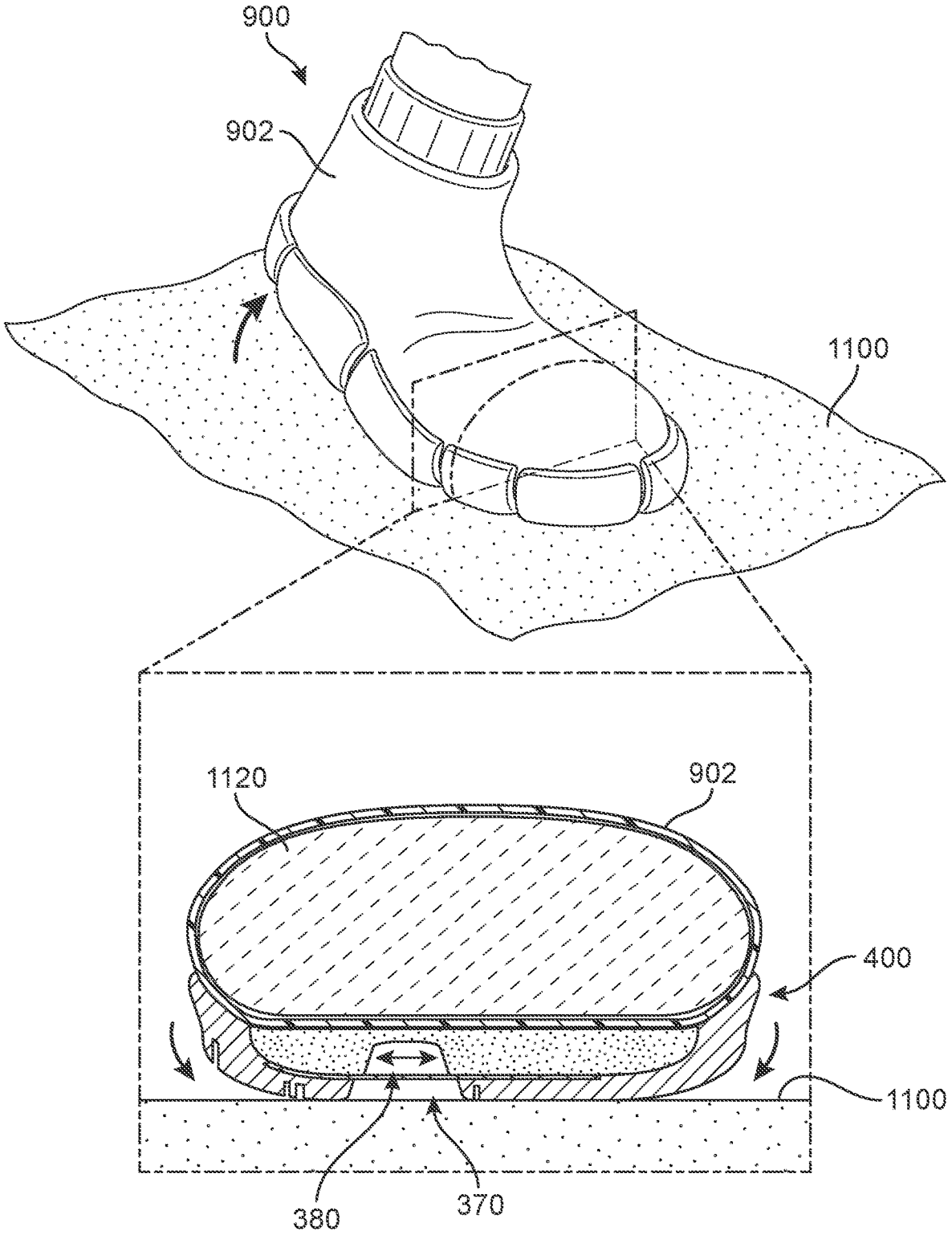

FIGS. 22-25 illustrate schematic views of a sequence of states of an article during a motion in which the article is initially on contact with a ground surface and is launched off the ground, according to an embodiment. Referring first to FIG. 22, article 900 is in contact with a ground surface 1100 during an unloaded state. In this state, only central region 520 of outer surface 410 of sole system 400 is in contact with ground surface 1100, while peripheral region 522 (on both the lateral and medial sides) are curved up and away from ground surface 1100. As a downward force is applied by the forefoot against ground surface 1100, foot 1120 tends to flatten and increase in width, as seen in FIG. 23. The contoured geometry of sole system 400 in the neutral state allows sole system 400 to also flatten out and thereby expand to accommodate expansion of foot 1120. In some cases, additional expansion could occur along one or more gaps (e.g., forward central gap 370) and along one or more grooves (e.g., forward central groove 380).

Figure 24:
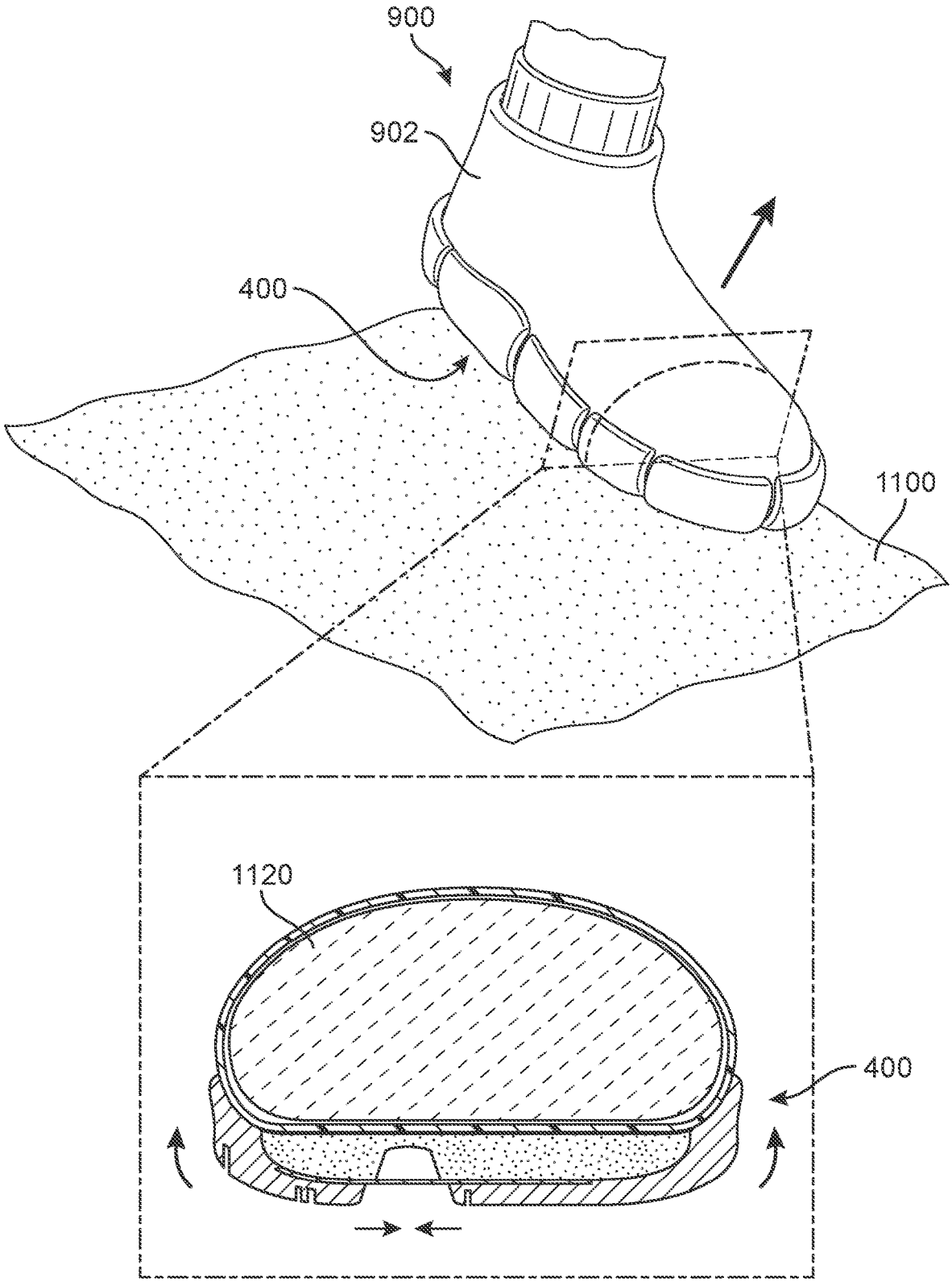
Figure 25:
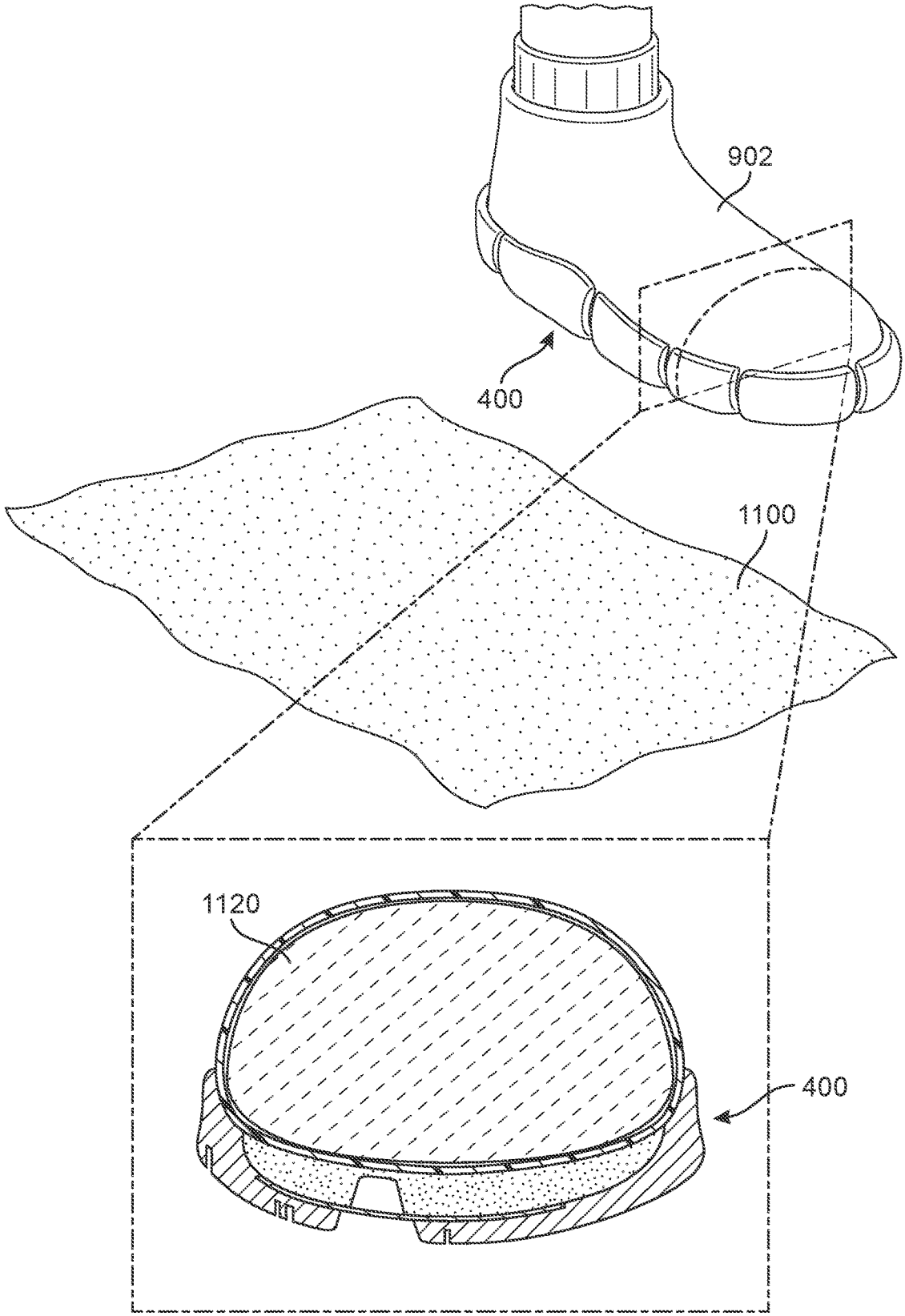

As foot 1120 is lifted off away from ground surface in FIG. 24, sole system 400 may rebound back to its neutral state, in which its inner and outer surfaces are contoured. More specifically, because sole system is preloaded into a contoured shape it naturally returns to this shape when the applied loads are reduced, until finally sole system 400 returns to its neutral state as shown in FIG. 25. Thus, sole system 400 provides recovery as the sole 'springs' back to its neutral position and provides some energy return while also quickly adapting back to the neutral shape of the foot.

Figure 26:
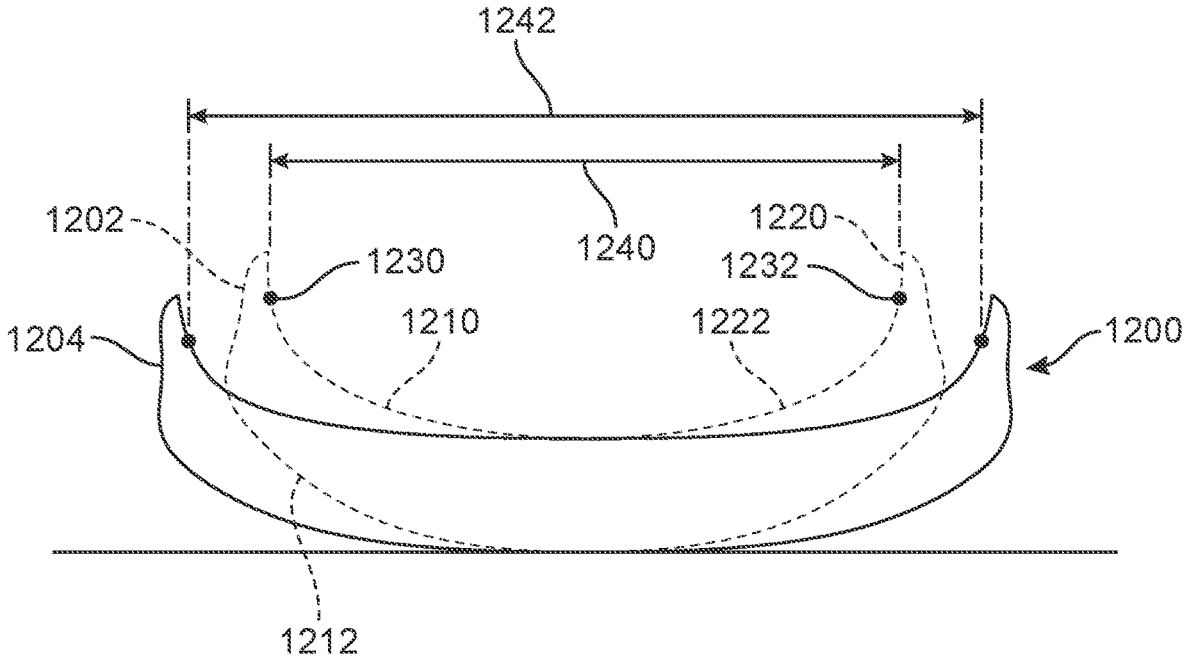
FIG. 26 is a schematic view of an embodiment of a sole system in an unloaded state superimposed over the sole system in a loaded state.

FIG. 26 is a schematic view of a sole system 1200 in two states: an unloaded state 1202 (shown in phantom) and a loaded state 1204 (shown in solid lines). For purposes of clarity, sole system 1200 is shown schematically without any particular sub-structures, however it may be appreciated that sole system 1200 may share many features with sole system 400 including a concave inner surface 1210 and a convex outer surface 1212 (in the unloaded state). Inner surface 1210 also includes a peripheral surface region 1220 and a central surface region 1222. Furthermore, sole system 1200 includes a first peripheral location 1230 and a second peripheral location 1232 on peripheral surface region 1220.

As shown in FIG. 26, as forces are applied to sole system 1200 (i.e., by a foot) causing it to change from unloaded state 1202 to loaded state 1204, the distance between first peripheral location 1230 and second peripheral location 1232 increases from a distance value 1240 to a distance value 1242. Thus, the overall width of sole system 1200 along inner surface 1210 is increased, thereby accommodating an increase in width of the foot, as occurs, for example, in the state shown in FIG. 23.

The dynamics of sole system 400 as shown in FIGS. 22-25 also provide a means for dynamically increasing traction during, for example, a heel to toe off motion. Specifically, the convex or rocker-like outer surface of sole system 400 provides a central region of contact with the ground initially. However, as the sole dynamically splays out and widens more of the outer surface comes into contact with the ground, thereby providing increasing amounts of traction and then reducing traction with the ground as the foot begins to lift off.

It may be appreciated that in other embodiments, an article may include a sole with a bowed shape (with a convex outer surface and a concave inner surface) and may not include a layer of material (upper, etc.) that is stretched across the inner concave surface. In other such embodiments, the concave inner surface of the sole may be sufficient to conform to the bottom of the foot during use and provide response upon stretching or flattening of the sole. In some cases, configuring the upper with sufficient tension from the top of the foot to the attached region at the sole periphery would help keep the sole curved around the bottom of the foot prior to loading.

Figure 27:
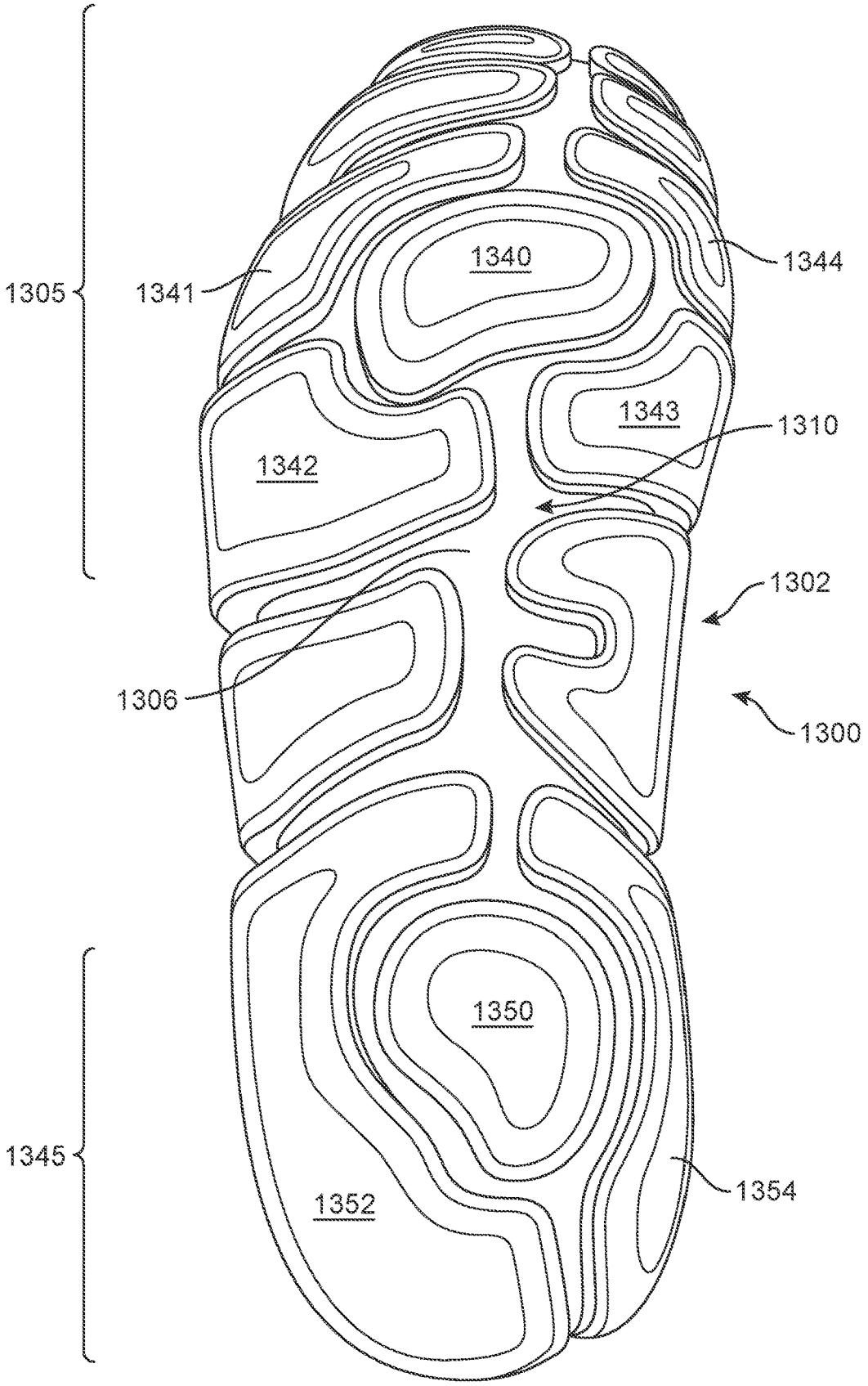
FIG. 27 is a schematic view of an embodiment of a sole system.
Figure 28:
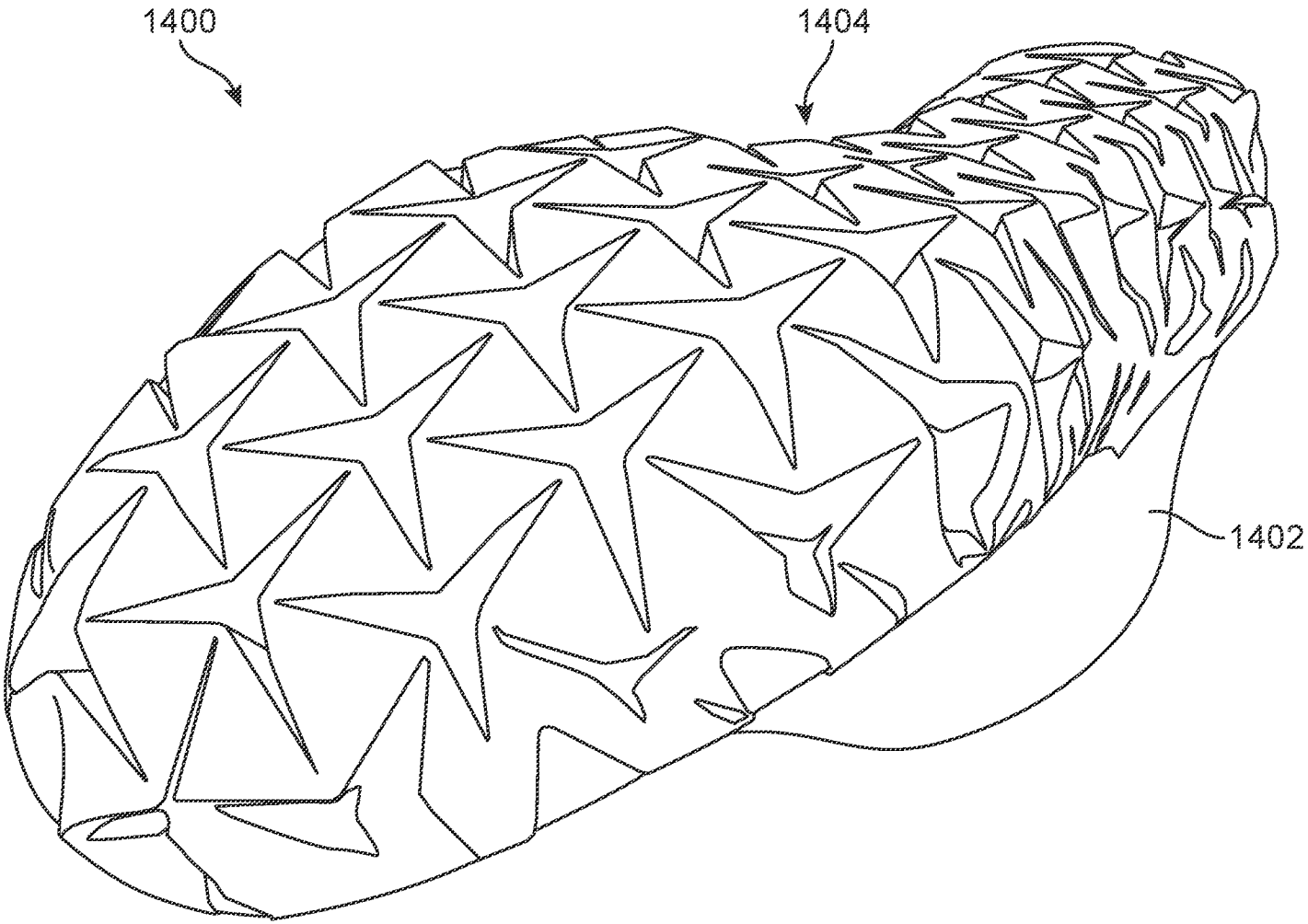
FIG. 28 is a schematic view of an embodiment of a sole system.
Figure 29:
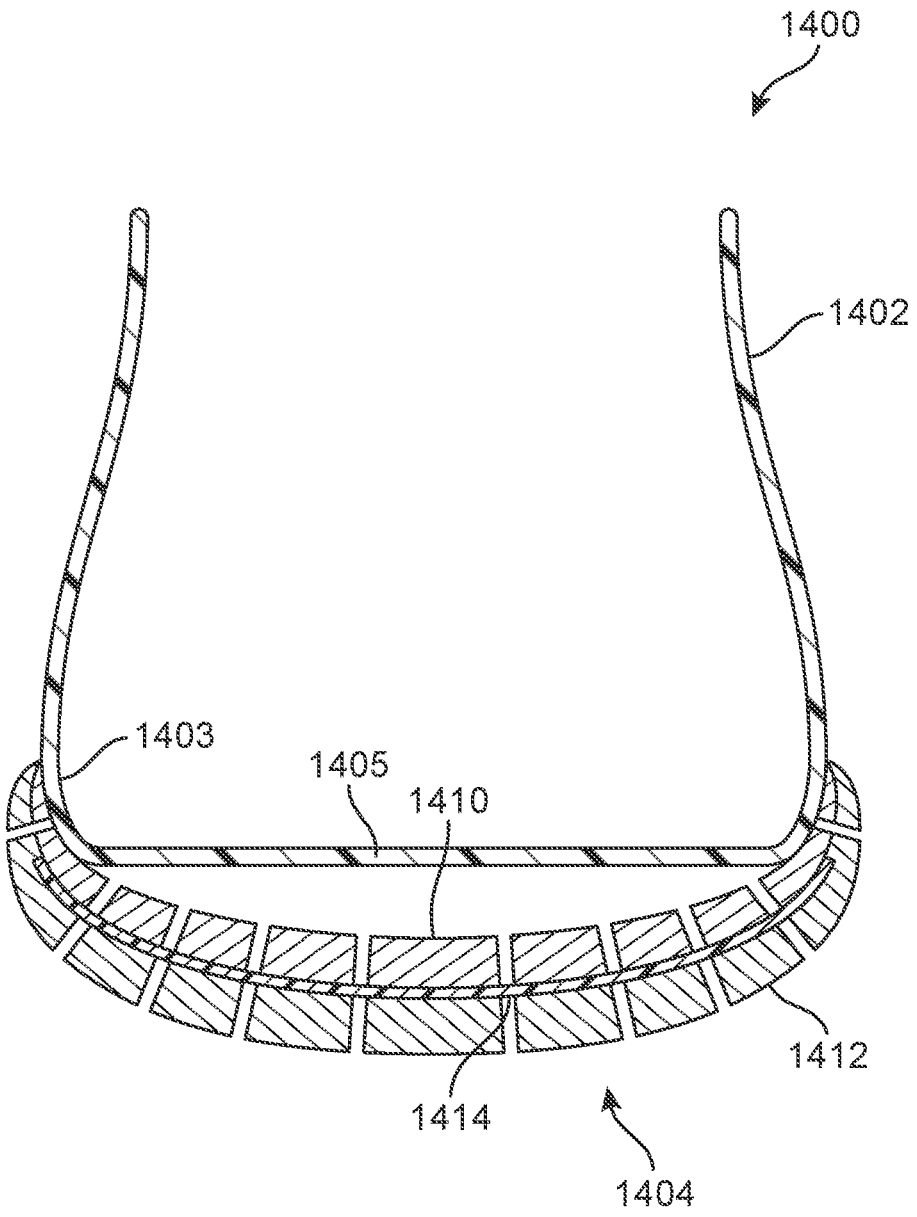
FIG. 29 is a schematic cross-sectional view of the sole system of FIG. 28.

FIGS. 27-29 illustrate additional embodiments that may incorporate some or all of the provisions described above and shown in the embodiments of FIGS. 1-16.

FIG. 27 is a schematic view of another embodiment of a sole system 1300 that uses a different gap/groove pattern, and therefore also uses differently shaped sole members, to achieve an adaptive and dynamic fit for a foot. In some embodiments, sole system 1300 may be similar in one or more respects to sole system 400. For example, sole system 1300 may comprise both an outer sole assembly 1302 and a middle sole assembly (not visible) joined by an intermediate layer 1306 (which may be, e.g., a TPU membrane). In contrast to sole system 400, however, sole system 1404 uses a distinct pattern of gaps 1310 (and also grooves/gaps inside, which are not visible) to provide a unique adaptive fit to the foot. Gaps 1310 divide outer sole assembly 1302 into various irregularly shaped outer sole members, while internal grooves divide an internal middle sole assembly into corresponding middle sole members (not shown).

As shown in FIG. 27, the current embodiment includes not only distinct lateral and medial outer (and inner) sole members, but also central outer (and inner) sole members that are completely surrounded by intermediate layer 1306. For example, in forefoot region 1305 outer sole assembly 1302 includes a central outer sole member 1340 that is surrounded by intermediate layer 1306. Moreover, central outer sole member 1340 is surrounded by a first lateral outer sole member 1341, a second lateral outer sole member 1342, a first medial outer sole member 1343 and a second medial outer sole member 1344. In heel region 1345, another central outer sole member 1350 is bounded by intermediate layer 1306 and also surrounded by two opposing lateral and medial outer sole members (outer sole member 1352 and outer sole member 1354).

It may be appreciated that any of the provisions described above for sole system 104 and sole system 400, shown in FIGS. 1-26, can be incorporated into the embodiment of sole system 1300 and vice versa. For example, although not shown, sole system 1300 could be attached to an upper in a manner similar to previous embodiments to give the upper a 'trampoline' configuration with the sole system and provide for an improved dynamic fit of the upper.

FIGS. 28-29 illustrate still another embodiment using one or more sole components having auxetic properties. Specifically, FIG. 28 is a schematic isometric view of an article 1400 with an upper 1402 and sole system 1404, while FIG. 29 is a schematic cross-sectional view of article 1400. In some embodiments, sole system 1404 may comprise an inner auxetic member 1410 and an outer auxetic member 1412, as well as an intermediate layer 1414 joining member 1410 and member 1412. An auxetic member has a negative Poisson's ratio, such that when they are under tension in a first direction, their dimensions increase both in the first direction and in a second direction orthogonal or perpendicular to the first direction. In at least some embodiments, intermediate layer 1414 is a TPU membrane.

As shown in FIG. 29, upper 1402 is arranged in similar 'trampoline' configuration to that shown for upper 902 and sole system 400 above. Specifically, upper 1402 is only attached to sole system 1404 at a peripheral attachment region 1403 and a bottom portion 1405 of upper 1402 is held in tension above an inner concave surface of sole system 1404.

In operation, sole system 1404 may function similarly to sole systems of the previous embodiments, with sole system 1404 tending to flatten out during loading as the auxetic layers provide sufficient flexibility for such deformation.

Embodiments can use any of the features, structures, components, systems and/or methods related to auxetic soles as disclosed in Cross, U.S. Patent Publication Number 2015/0075033, published Mar. 19, 2015 (previously U.S. application Ser. No. 14/030,002, filed Sep. 18, 2013), and titled "Auxetic Structures and Footwear with Soles Having Auxetic Structures," the entirety of which is herein incorporated by reference and included in the attached "Appendix A".

Embodiments may include provisions for manufacturing a sole system. In some embodiments, a sole system can be manufactured to achieve a contoured sole with an inner concave surface and an outer convex surface. In a first step of manufacturing a middle sole assembly could be molded and then bonded with an intermediate layer. In one or more embodiments, the intermediate layer may be a polymeric membrane, a thermoplastic polymeric membrane, or an elastomeric thermoplastic polymeric membrane. Further, in one or more embodiments, the intermediate layer may include a polyurethane polymer material and/or a polyamide material. For example, according to one or more embodiments, the intermediate layer may be a TPU membrane. Generally, the intermediate layer can be selected with a geometry and material composition that facilitates increased elasticity in the intermediate layer relative to adjacent sole members (in the outer sole assembly or middle sole assembly). In some embodiments, the intermediate layer could be significantly thinner than the adjacent sole members to facilitate this increased elasticity. Moreover, the intermediate layer may have a thickness that is much thinner than either its width or length.

Next, the unit comprised of the middle sole assembly and the TPU membrane may be inserted into, and bonded with, components of an outer sole assembly that have also been molded in a previous step to form a sole system. In some other embodiments the outer sole assembly and the middle sole assembly could be co-molded.

An upper with a tension fit, or a stretch fit, may be fit over a first last (a 'fitting' last) with a first size. Once the upper is properly fitted, the upper is removed and placed onto a second last (an 'assembly' last) that has a second size that is larger than the first size of the first last (e.g., the first size is a size 6 and the second size is a size 8). The second last may also be provided with a convex bottom corresponding to the concave inner surface of the sole system. The periphery of the outer sole assembly may then be wrapped up around the lower sides of the upper and bonded to the upper (e.g., cemented) to form the article. Upon removing the second last (the assembly last) from the upper of the article the sole system may be de-lasted or decoupled from the bottom of the upper, which is stretched in tension over the concave inner sole surface.

Figure 30:
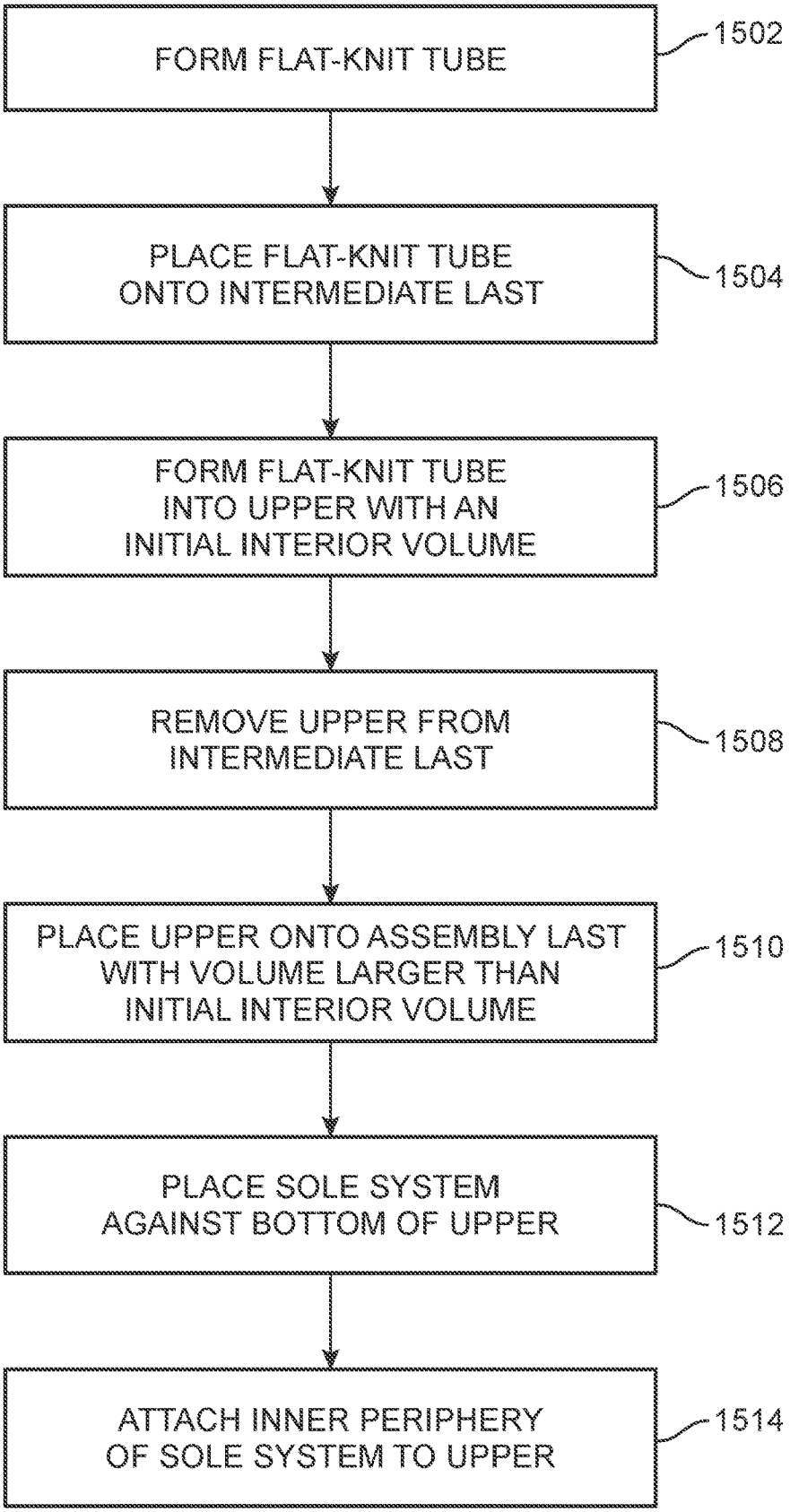
FIG. 30 is a schematic view of a process for making an article of footwear according to an embodiment.
Figure 31:
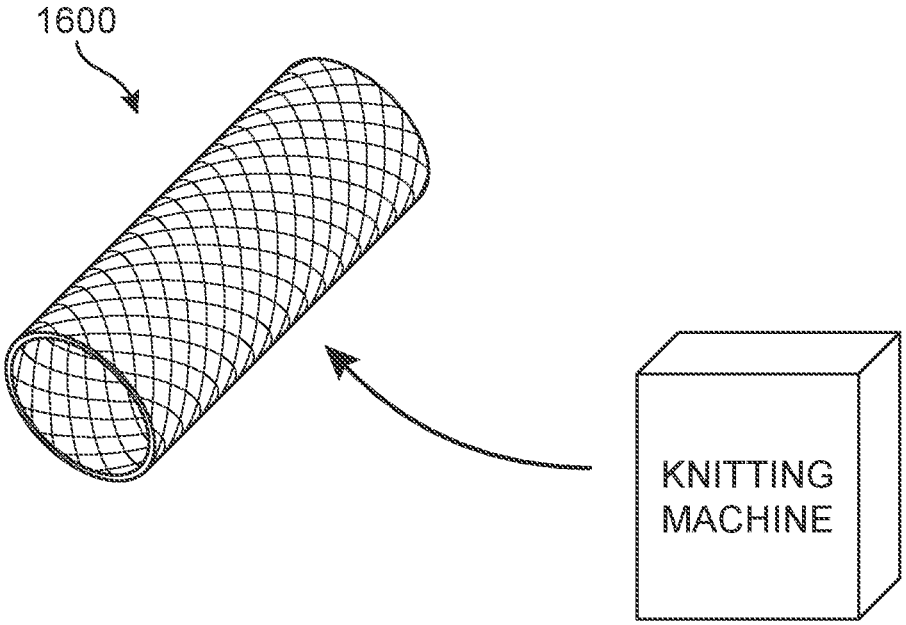
FIG. 31 is a schematic view of a knitted tube according to an embodiment.
Figure 32:
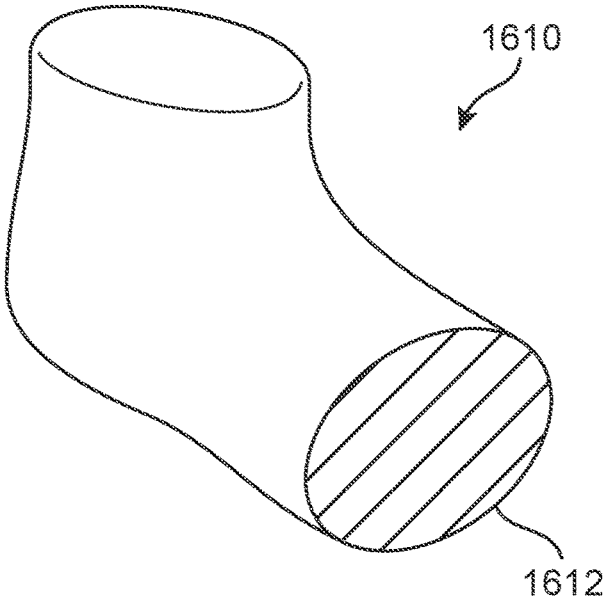
FIG. 32 is a schematic view of a last according to an embodiment.
Figure 33:
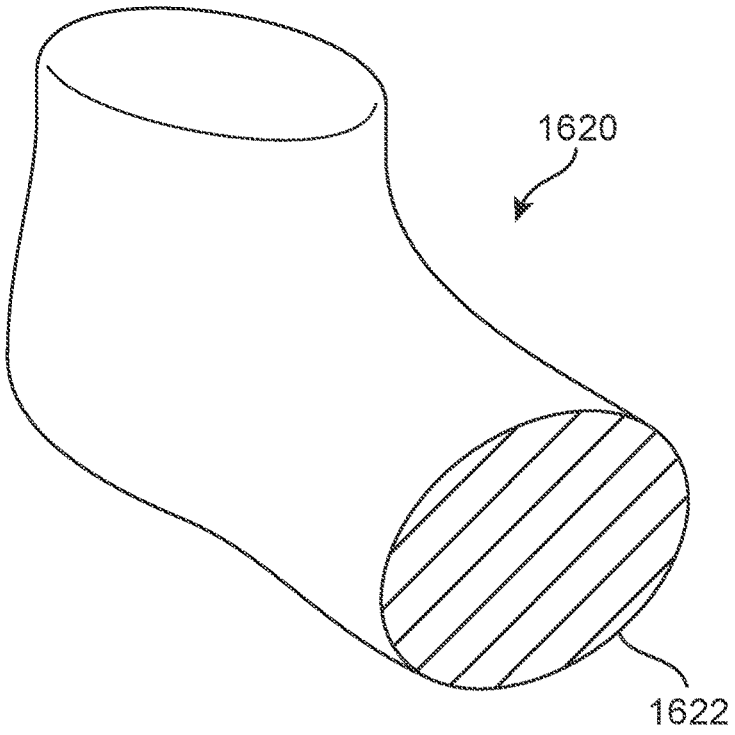
FIG. 33 is a schematic view of a last according to an embodiment.

FIG. 30 is a schematic view of a process or method for making an article, such as article 100 or article 900 described above, according to an embodiment. FIGS. 31-33 illustrate schematic views of various components that may be used in the method described in FIG. 30.

Referring to FIG. 30, the method may start with forming a knitted structure using a knitting machine at a step 1502. In some cases, the structure may be a tube. In some cases, the structure could be a seamless tube. In some cases, the knitted structure may be a flat-knit structure. An exemplary flat-knitted tube 1600 is shown in FIG. 31. Generally, any methods of forming a knitted structure that can be used in making a tension or stretch fit upper may be used.

Although the exemplary embodiment discussed with respect to FIG. 30 uses a knit upper; other embodiments could use other upper constructions. In other embodiments, any upper with an elastic bottom portion (the portion of the upper configured to underlie a user's foot during use) could be used. This includes any of the upper constructions having elastic portions that have been previously discussed.

Next, in step 1504 the knitted structure could be placed onto a first, or 'intermediate', last. An exemplary intermediate last 1610 is shown in FIG. 32. In some cases, the intermediate last could be associated with a first shoe size. In one example, the first shoe size could be a US size 6. In some cases, the intermediate last could have a rounded or convex lower surface. For example, in FIG. 32, intermediate last 1610 includes a convex lower surface 1612. In other cases, the intermediate last could have a flat lower surface. Using a convex lower surface may help to form upper with a desired geometry that adapts to the curvature of a foot.

In step 1506, the knitted structure can be formed into an upper on the intermediate last. The upper may be associated with an initial interior volume, which is determined by the volume or geometry of the intermediate last. In some embodiments, the upper could be formed by shaping a knitted structure on the intermediate last without cutting, sewing or other bonding methods. In some cases, the knitted structure could be 'shaped' over the last by stretching, or using heat and/or pressure to set the knitted structure into a particular shape. In other embodiments, various portions of the knitted structure could be cut and reattached, or different segments could be pulled and attached together without cutting, to form a structure with the desired volume and shape of the intermediate last.

In step 1508 the formed upper with the initial interior volume can be removed from the intermediate last. Next, in step 1510, the upper can be placed onto an assembly last for attaching the tooling (i.e., the sole system) to the upper to form an article of footwear. FIG. 33 shows an exemplary assembly last 1620 that could be used. As seen in comparing FIGS. 32 and 33, assembly last 1620 is significantly larger (in volume) than intermediate last 1612. Moreover, the assembly last may have a volume that is greater than the initial interior volume of the upper. In particular, the upper is elastically stretched over the upper, and the bottom portion of the upper is elastically stretched along the convex lower surface 1622 of assembly last 1622. This allows the upper, or at least the bottom portion of the upper, to be placed in tension (i.e., stretch fit, or tension fit), around the assembly last during the assembly process. In particular, the upper is provided with a larger volume than the initial interior volume such that the bottom portion of the upper is tensed during assembly with the sole system.

In some embodiments, the assembly last could have a convex lower surface. For example, assembly last 1620 of FIG. 33 has a convex lower surface 1622. In other embodiments, the assembly last could have a flat lower surface. Using a convex lower surface allows the tooling to be attached to the upper such that the lower surface of the upper is in tension or stretched across the concave inner surface of the tooling, thereby creating the trampoline configuration discussed previously for an article and shown, for example, in FIGS. 20-21, and helping to keep the sole system curved, in an unloaded state of the article of footwear. In embodiments, the volume alone of the assembly last, irrespective of whether the lower surface of the assembly last is flat or convex, is configured to induce tension in the upper, and/or cause elastic stretching or deformation of the upper, when the upper is pulled over the assembly last.

In step 1512 the sole system is placed into position relative to, and into contact with, the bottom of the upper (with the upper still on the assembly last). In step 1514 the inner periphery, or inner peripheral surface region, of the sole system is bonded to the lower region of the upper (forming an attachment region of the upper). The bottom portion of the upper is not bonded with the central portion of the inner sole surface, which leaves the bottom portion of the upper free to be held in tension across the inner sole surface. Once the upper and sole system (now an assembled article of footwear) have been removed from the assembly last, the elastic stretching in the bottom portion of the upper may decrease, and the bottom portion of the upper may help induce the curvature along a transverse axis of the sole structure.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A sole, comprising:

an outer sole assembly including a plurality of outer sole members spaced apart from each other by a plurality of gaps;

a middle sole assembly defining a plurality of grooves; and an intermediate layer comprising an elastomer, wherein the intermediate layer is disposed between the outer sole assembly and the middle sole assembly, and the intermediate layer connects the middle sole assembly to the outer sole assembly;

wherein the intermediate layer is more elastic than each of the plurality of outer sole members;

wherein the intermediate layer is more elastic than the middle sole assembly; and wherein the plurality of gaps includes a forward central gap that separates the sole between a lateral portion and a medial portion.

2. The sole according to claim 1, wherein the intermediate layer extends across at least one groove to separate the at least one groove from a vertically aligned gap.

3. The sole according to claim 1, wherein the outer sole assembly further includes at least one connecting member that locally couples two adjacent outer sole members.

4. The sole according to claim 1, wherein the intermediate layer is a TPU membrane, and one of the plurality of gaps is vertically aligned with a respective one of the plurality of grooves.

5. The sole according to claim 1, wherein the intermediate layer has a different material composition than either the middle sole assembly or the outer sole assembly.

6. The sole according to claim 1, wherein the sole is expandable along at least one of the plurality of gaps upon application of a downward force to the sole.

7. The sole according to claim 1, wherein the intermediate layer is a unitary, one-piece structure.

8. The sole according to claim 1, wherein the plurality of grooves do not extend through an entirety of a thickness of the middle sole assembly.

9. The sole according to claim 8, wherein at least some of the plurality of gaps extend through an entirety of a thickness of the outer sole assembly.

10. The sole according to claim 1, wherein the intermediate layer includes a continuous medial side and a plurality of fingers extending from the continuous medial side toward a lateral side of sole.

11. The sole according to claim 1, wherein the outer sole assembly includes a base sole portion and a peripheral sole portion extending from the base sole portion.

12. The sole according to claim 11, wherein the peripheral sole portion is configured to wrap up around a lower peripheral edge of an upper.

13. The sole according to claim 1, wherein the plurality of outer sole members includes a forwardly disposed outer sole member, and the outer sole assembly includes a first tread pad and a second tread pad each coupled to the forwardly disposed outer sole member.

14. The sole according to claim 13, wherein the plurality of gaps includes a peripheral gap partially disposed between the first tread pad and the second tread pad.

15. An article of footwear, comprising:

an upper including a bottom portion and a lower region coupled to the bottom portion;

a sole comprising a middle sole assembly and an outer sole assembly;

the outer sole assembly including a peripheral sole portion that wraps up around and attaches to the lower region of the upper;

the outer sole assembly including a lateral outer sole member, a medial outer sole member, and a forwardly disposed outer sole member;

the outer sole assembly includes a first tread pad and a second tread pad each coupled to the forwardly disposed outer sole member;

the middle sole assembly including a lateral middle sole member and a medial middle sole member, wherein the lateral middle sole member and the medial middle sole member are spaced apart by a groove;

an intermediate layer connecting the middle sole assembly and the outer sole assembly;

wherein the bottom portion of the upper is located inwardly of the middle sole assembly;

wherein the intermediate layer is more elastic than the outer sole assembly;

wherein the intermediate layer is more elastic than the middle sole assembly; and wherein the lateral outer sole member and the medial outer sole member are spaced apart by a gap.

16. The article of footwear according to claim 15, wherein the gap is vertically aligned with the groove.

17. The article of footwear according to claim 15, wherein the intermediate layer comprises an elastic material.

18. The article of footwear according to claim 17, wherein the elastic material is thermoplastic polyurethane.

19. The article of footwear according to claim 15, wherein the gap extends from a forward edge of the sole to a heel region of the sole, the groove extends from the forward edge to the heel region.

20. The article of footwear according to claim 15, and the intermediate layer is a one-piece structure.

* * * * *